US008026673B2

(12) United States Patent
Lys

(10) Patent No.: US 8,026,673 B2
(45) **Date of Patent: *Sep. 27, 2011**

(54) METHODS AND APPARATUS FOR SIMULATING RESISTIVE LOADS

(75) Inventor: Ihor A. Lys, Milton, MA (US)

(73) Assignee: Philips Solid-State Lighting Solutions, Inc., Burlington, MA (US)

( * ) Notice: Subject to any disclaimer, the term of this patent is extended or adjusted under 35 U.S.C. 154(b) by 1083 days.

This patent is subject to a terminal disclaimer.

(21) Appl. No.: 11/836,568

(22) Filed: Aug. 9, 2007

(65) Prior Publication Data

US 2008/0164827 A1 Jul. 10, 2008

Related U.S. Application Data

(60) Provisional application No. 60/883,626, filed on Jan. 5, 2007.

(51) Int. Cl.
*G05F 1/00* (2006.01)

(52) U.S. Cl. ..... 315/291; 315/312; 315/307; 315/225; 363/34; 345/82

(58) Field of Classification Search ..... 315/291, 315/307, 169.1, 169.3, 312, 225, 209 R; 345/82, 345/102; 363/34, 56.01, 56.02
See application file for complete search history.

(56) References Cited

U.S. PATENT DOCUMENTS 5,688,042 A 11/1997 Madadi et al.
6,016,038 A 1/2000 Mueller et al.
6,072,280 A 6/2000 Allen
6,150,771 A 11/2000 Perry
6,150,774 A 11/2000 Mueller et al.
6,166,496 A 12/2000 Lys et al.
6,211,626 B1 4/2001 Lys et al.
6,292,901 B1 9/2001 Lys et al.
6,340,868 B1 1/2002 Lys et al.
D457,667 S 5/2002 Piepgras et al.
D457,669 S 5/2002 Piepgras et al.
D457,974 S 5/2002 Piepgras et al.
D458,395 S 6/2002 Piepgras et al.
D463,610 S 9/2002 Piepgras et al.
6,459,919 B1 10/2002 Lys et al.
6,461,019 B1 10/2002 Allen
D468,035 S 12/2002 Piepgras et al.
6,528,954 B1 3/2003 Lys et al.
6,548,967 B1 4/2003 Dowling et al.
(Continued)

FOREIGN PATENT DOCUMENTS

EP 0991304 A 4/2000
(Continued)

*Primary Examiner* — Haissa Philogene
(74) *Attorney, Agent, or Firm* — Mark L Beloborodov

(57) ABSTRACT

Methods and apparatus for simulating resistive loads, and facilitating series, parallel, and/or series-parallel connections of multiple loads to draw operating power. Current-to-voltage characteristics of loads are altered in a predetermined manner so as to facilitate a predictable and/or desirable behavior of multiple loads drawing power from a power source. Exemplary loads include LED-based light sources and LED-based lighting units. Altered current-to-voltage characteristics may cause a load to appear as a substantially linear or resistive element to the power source, at least over some operating range. In connections of multiple such loads, the voltage across each load is relatively more predictable. In one example, a series connection of multiple loads with altered current-to-voltage characteristics may be operated from a line voltage without requiring a transformer.

27 Claims, 21 Drawing Sheets

U.S. PATENT DOCUMENTS 6,570,505 B1 5/2003 Malenfant
6,577,080 B2 6/2003 Lys et al.
6,580,228 B1 6/2003 Chen et al.
6,608,453 B2 8/2003 Morgan et al.
6,621,235 B2 9/2003 Chang
6,624,597 B2 9/2003 Dowling et al.
6,636,003 B2 10/2003 Rahm et al.
6,680,579 B2 1/2004 Allen et al.
6,717,376 B2 4/2004 Lys et al.
6,720,745 B2 4/2004 Mueller et al.
D491,678 S 6/2004 Piepgras et al.
D492,042 S 6/2004 Piepgras et al.
6,774,584 B2 8/2004 Lys et al.
6,777,891 B2 8/2004 Lys et al.
6,781,329 B2 8/2004 Morgan et al.
6,788,011 B2 9/2004 Mueller et al.
6,801,003 B2 10/2004 Schanberger et al.
6,806,659 B1 10/2004 Mueller et al.
6,869,204 B2 3/2005 Morgan et al.
6,883,929 B2 4/2005 Dowling
6,888,322 B2 5/2005 Dowling et al.
6,897,624 B2 5/2005 Durcharme et al.
6,936,978 B2 8/2005 Morgan et al.
6,965,205 B2 11/2005 Piepgras et al.
6,967,448 B2 11/2005 Morgan et al.
6,969,954 B2 11/2005 Lys
6,975,079 B2 12/2005 Lys et al.
D518,218 S 3/2006 Roberge et al.
7,014,336 B1 3/2006 Ducharme et al.
7,031,920 B2 4/2006 Dowling et al.
7,038,398 B1 5/2006 Lys et al.
7,038,399 B2 5/2006 Lys et al.
7,042,172 B2 5/2006 Dowling et al.
7,064,498 B2 6/2006 Dowling et al.
7,113,541 B1 9/2006 Lys et al.
7,132,785 B2 11/2006 Ducharme
7,132,804 B2 11/2006 Mueller et al.
7,135,824 B2 11/2006 Lys et al.
7,139,617 B1 11/2006 Morgan et al.
7,161,311 B2 1/2007 Mueller et al.
7,161,313 B2 1/2007 Piepgras et al.
7,161,556 B2 1/2007 Morgan et al.
7,173,383 B2 * 2/2007 Vornsand et al. ..... 315/291
7,178,941 B2 2/2007 Roberge et al.
7,180,252 B2 2/2007 Mueller et al.
7,186,003 B2 3/2007 Dowling et al.
7,187,141 B2 3/2007 Mueller et al.
7,202,613 B2 4/2007 Morgan et al.
7,204,622 B2 4/2007 Dowling et al.
7,220,015 B2 5/2007 Dowling
7,221,104 B2 5/2007 Lys et al.
7,228,190 B2 6/2007 Dowling et al.
7,231,060 B2 6/2007 Dowling et al.
7,233,115 B2 6/2007 Lys
7,233,831 B2 6/2007 Blackwell
7,242,152 B2 7/2007 Dowling et al.
7,248,239 B2 7/2007 Dowling et al.
D548,868 S 8/2007 Roberge et al.
7,253,566 B2 8/2007 Lys et al.
7,255,457 B2 8/2007 Ducharme et al.
7,256,554 B2 8/2007 Lys
7,274,160 B2 9/2007 Mueller et al.
7,300,192 B2 11/2007 Mueller et al.
7,303,300 B2 12/2007 Dowling et al.
7,308,296 B2 12/2007 Lys et al.
7,309,965 B2 12/2007 Dowling et al.
D562,494 S 2/2008 Piepgras et al.
7,408,308 B2 * 8/2008 Sawada et al. ..... 315/291
2002/0074559 A1 6/2002 Dowling et al.
2002/0078221 A1 6/2002 Blackwell et al.
2002/0130627 A1 9/2002 Dowling et al.
2002/0152045 A1 10/2002 Dowling et al.
2002/0176259 A1 11/2002 Ducharme
2003/0057884 A1 3/2003 Dowling et al.
2003/0057886 A1 3/2003 Lys et al.
2003/0076281 A1 4/2003 Morgan et al.
2003/0133292 A1 7/2003 Mueller et al.
2004/0052076 A1 3/2004 Mueller et al.
2004/0105261 A1 6/2004 Ducharme et al.
2004/0116039 A1 6/2004 Mueller et al.
2004/0141321 A1 7/2004 Dowling et al.
2004/0212993 A1 10/2004 Morgan et al.
2005/0035728 A1 2/2005 Dowling et al.
2005/0041161 A1 2/2005 Dowling et al.
2005/0047134 A1 3/2005 Mueller et al.
2005/0063194 A1 3/2005 Mueller et al.
2005/0099824 A1 5/2005 Dowling et al.
2005/0116667 A1 6/2005 Mueller et al.
2005/0151489 A1 7/2005 Lys et al.
2005/0174473 A1 8/2005 Dowling et al.
2005/0213352 A1 9/2005 Lys et al.
2005/0213353 A1 9/2005 Lys
2005/0218870 A1 10/2005 Lys
2005/0219872 A1 10/2005 Lys
2005/0236998 A1 10/2005 Mueller
2005/0248299 A1 11/2005 Chemel et al.
2005/0253533 A1 11/2005 Lys et al.
2005/0275626 A1 12/2005 Mueller
2005/0276053 A1 12/2005 Nortrup
2006/0002110 A1 1/2006 Dowling
2006/0012987 A9 1/2006 Ducharme
2006/0016960 A1 1/2006 Morgan
2006/0022214 A1 2/2006 Morgan
2006/0076908 A1 4/2006 Morgan
2006/0098077 A1 5/2006 Dowling
2006/0104058 A1 5/2006 Chemel et al.
2006/0109649 A1 5/2006 Ducharme et al.
2006/0132061 A1 6/2006 McCormick et al.
2006/0152172 A9 7/2006 Mueller
2006/0158881 A1 7/2006 Dowling
2006/0170376 A1 8/2006 Dowling et al.
2006/0198128 A1 9/2006 Piepgras et al.
2006/0208667 A1 9/2006 Lys
2006/0221606 A1 10/2006 Dowling
2006/0262521 A1 11/2006 Piepgras
2006/0262544 A1 11/2006 Piepgras
2006/0262545 A1 11/2006 Piepgras
2006/0273741 A1 12/2006 Stalker, III
2006/0285325 A1 12/2006 Ducharme et al.
2007/0086754 A1 4/2007 Lys et al.
2007/0086912 A1 4/2007 Dowling
2007/0115658 A1 5/2007 Mueller
2007/0115665 A1 5/2007 Mueller
2007/0145915 A1 6/2007 Roberge
2007/0152797 A1 7/2007 Chemel et al.
2007/0153514 A1 7/2007 Dowling
2007/0188114 A1 8/2007 Lys et al.
2007/0188427 A1 8/2007 Lys et al.
2007/0189026 A1 8/2007 Chemel et al.
2007/0195526 A1 8/2007 Mueller et al.
2007/0206375 A1 9/2007 Piegras et al.
2007/0236156 A1 10/2007 Lys et al.
2007/0237284 A1 10/2007 Lys et al.
2007/0258231 A1 11/2007 Koerner et al.
2007/0258240 A1 11/2007 Ducharme et al.
2007/0263379 A1 11/2007 Dowling et al.
2007/0291483 A1 12/2007 Lys et al.
2008/0012502 A1 1/2008 Lys
2008/0012506 A1 1/2008 Mueller et al.
2008/0164854 A1 * 7/2008 Lys ..... 323/226

FOREIGN PATENT DOCUMENTS

JP 11-135274 5/1999

* cited by examiner

METHODS AND APPARATUS FOR SIMULATING RESISTIVE LOADS

CROSS-REFERENCE TO RELATED APPLICATION

The present application claims the benefit, under 35 U.S.C. §119(e), of U.S. Provisional Application Ser. No. 60/883,626, filed Jan. 5, 2007, entitled "Methods and Apparatus for Providing Resistive Lighting Units," which application is hereby incorporated herein by reference.

BACKGROUND

Light emitting diodes (LEDs) are semiconductor-based light sources traditionally employed in low-power instrumentation and appliance applications for indication purposes and are available in a variety of colors (e.g., red, green, yellow, blue, white), based on the types of materials used in their fabrication. This color variety of LEDs has been recently exploited to create novel LED-based light sources having sufficient light output for new space-illumination and direct view applications. For example, as discussed in U.S. Pat. No. 6,016,038, incorporated herein by reference, multiple differently colored LEDs may be combined in a lighting fixture having one or more internal microprocessors, wherein the intensity of the LEDs of each different color is independently controlled and varied to produce a number of different hues. In one example of such an apparatus, red, green, and blue LEDs are used in combination to produce literally hundreds of different hues from a single lighting fixture. Additionally, the relative intensities of the red, green, and blue LEDs may be computer controlled, thereby providing a programmable multi-channel light source, capable of generating any color and any sequence of colors at varying intensities and saturations, enabling a wide range of eye-catching lighting effects. Such LED-based light sources have been recently employed in a variety of fixture types and a variety of lighting applications in which variable color lighting effects are desired.

These lighting systems and the effects they produce can be controlled and coordinated through a network, wherein a data stream containing packets of information is communicated to the lighting devices. Each of the lighting devices may register all of the packets of information passed through the system, but only respond to packets that are addressed to the particular device. Once a properly addressed packet of information arrives, the lighting device may read and execute the commands. This arrangement demands that each of the lighting devices have an address and these addresses need to be unique with respect to the other lighting devices on the network. The addresses are normally set by setting switches on each of the lighting devices during installation. Settings switches tends to be time consuming and error prone.

Lighting systems for entertainment, retail, and architectural venues, such as theaters, casinos, theme parks, stores, and shopping malls, require an assortment of elaborate lighting fixtures and control systems therefore to operate the lights. Conventional networked lighting devices have their addresses set through a series of physical switches such as dials, dipswitches or buttons. These devices have to be individually set to particular addresses and this process can be cumbersome. In fact, one of the lighting designers' most onerous tasks—system configuration—comes after all the lights are installed. This task typically requires at least two people and involves going to each lighting instrument or fixture and determining and setting the network address for it through the use of switches or dials and then determining the setup and corresponding element on a lighting board or computer. Not surprisingly, the configuration of lighting network can take many hours, depending on the location and complexity. For example, a new amusement park ride may use hundreds of network-controlled lighting fixtures, which are neither line-of-sight to each other or to any single point. Each one must be identified and linked to its setting on the lighting control board. Mix-ups and confusion are common during this process. With sufficient planning and coordination this address selection and setting can be done a priori but still requires substantial time and effort.

Addressing these disadvantages, U.S. Pat. No. 6,777,891 (the "'891 patent"), incorporated herein by reference, contemplates arranging a plurality of LED-based lighting units as a computer-controllable "light string," wherein each lighting unit constitutes an individually controllable "node" of the light string. Applications suitable for such light strings include decorative and entertainment-oriented lighting applications (e.g., Christmas tree lights, display lights, theme park lighting, video and other game arcade lighting, etc.). Via computer control, one or more such light strings provide a variety of complex temporal and color-changing lighting effects. In many implementations, lighting data is communicated to one or more nodes of a given light string in a serial manner, according to a variety of different data transmission and processing schemes, while power is provided in parallel to respective lighting units of the string (e.g., from a rectified high voltage source, in some instances with a substantial ripple voltage). In other implementations, individual lighting units of a light string are coupled together via a variety of different conduit configurations to provide for easy coupling and arrangement of multiple lighting units constituting the light string. Also, small LED-based lighting units capable of being arranged in a light string configuration are often manufactured as integrated circuits including data processing circuitry and control circuitry for LED light sources, and a given node of the light string may include one or more integrated circuits packaged with LEDs for convenient coupling to a conduit to connect multiple nodes.

Thus, the approach disclosed in the '891 patent provides a flexible low-voltage multi-color control solution for LED-based light strings that minimizes the number of components at the LED nodes. In view of the commercial success of this approach, the lighting industry desires longer strings with more nodes for complex applications.

SUMMARY

Applicant has recognized and appreciated that it is often useful to consider the connection of multiple lighting units or light sources, as well as other types of loads, to receive operating power in series rather than in parallel. A series interconnection of multiple loads may permit the use of higher voltages to provide operating power to the loads, and may also allow operation of multiple loads without requiring a transformer between a source of power (e.g., wall power or line voltage such as 120 VAC or 240 VAC) and the loads (i.e., multiple series-connected loads may be operated "directly" from a line voltage).

Accordingly, various aspects of the present invention are directed generally to methods and apparatus for facilitating a series connection of multiple loads to draw operating power from a power source. Some of the inventive embodiments disclosed herein relate to configurations, modifications and improvements that result in altered current-to-voltage (I-V) characteristics associated with loads. For example, current-to-voltage characteristics may be altered in a predetermined manner so as to facilitate a predictable and/or desirable behavior of the loads when they are connected in series to draw operating power from a power source, as well as parallel or series-parallel connections. In some exemplary inventive embodiments, the loads include LED-based light sources (including one or more LEDs) or LED-based lighting units, and current-to-voltage characteristics associated with LED-based light sources or lighting units are altered in a predetermined manner so as to facilitate a predictable and/or desirable behavior of the LED-based light sources/lighting units when they are connected in a variety of series, parallel, or series-parallel arrangements to draw operating power from a power source.

Applicant has particularly recognized and appreciated that various series, parallel, and series-parallel connections of multiple loads drawing power from a power source are generally facilitated by employing resistive loads. Accordingly, in some inventive embodiments, altered current-to-voltage characteristics according to methods and apparatus disclosed herein cause a load to appear as a substantially linear or "resistive" element (i.e. behaving similarly to a resistor), at least over some operating range, to a power source from which the load draws power.

In particular, in some embodiments of the present invention, loads with nonlinear and/or variable current-to-voltage characteristics, such as LED-based light sources or LED-based lighting units, are modified to simulate substantially linear or resistive elements, at least over some operating range, when they draw power from a power source. This, in turn, facilitates a series power connection of the modified LED-based light sources or lighting units, in which the voltage across each modified light source/lighting unit is relatively more predictable. Stated differently, the terminal voltage of a power source from which the series connection is drawing power is shared in a more predictable (e.g., equal) manner amongst the modified light sources/lighting units. By simulating a resistive load, such modified loads also may be connected in parallel, or in various series-parallel combinations, with predictable results with respect to terminal currents and voltages.

For example, one embodiment is directed to an apparatus, comprising at least one load having a nonlinear or variable current-to-voltage characteristic, and a converter circuit coupled to the at least one load and configured such that the apparatus has a substantially linear current-to-voltage characteristic over at least some range of operation. In one aspect, a first current conducted by the apparatus when the apparatus draws power from a power source is independent of a second current conducted by the load.

Another embodiment is directed to an apparatus, comprising at least one lighting unit having an operating voltage $V_L$ and an operating current $I_L$, wherein a first current-to-voltage characteristic based on the operating voltage $V_L$ and the operating current $I_L$ is significantly nonlinear or variable. The apparatus further comprises a converter circuit coupled to the at least one lighting unit to provide the operating voltage $V_L$, the converter circuit configured such that the apparatus conducts a terminal current $I_T$ and has a terminal voltage $V_T$ when the apparatus draws power from a power source. In various aspects, the operating voltage $V_L$ of the at least one lighting unit is less than the terminal voltage $V_T$ of the apparatus, the terminal current $I_T$ of the apparatus is independent of the operating current $I_L$ or the operating voltage $V_L$ of the at least one lighting unit, and a second current-to-voltage characteristic of the apparatus, based on the terminal voltage $V_T$ and the terminal current $I_T$, is substantially linear over a range of terminal voltages near a nominal operating point $V_T=V_{nom}$.

Another embodiment is directed to a method, comprising converting a nonlinear or variable current-to-voltage characteristic of at least one load to a substantially linear current-to-voltage characteristic, wherein the substantially linear current-to-voltage characteristic is independent of a current conducted by the load.

Another embodiment is directed to a lighting system, comprising a plurality of lighting nodes coupled in series to draw power from a power source. Each lighting node of the plurality of lighting nodes comprises at least one lighting unit having a significantly nonlinear or variable current-to-voltage characteristic, and a converter circuit coupled to the at least one lighting unit and configured such that the lighting node has a substantially linear current-to-voltage characteristic over at least some range of operation.

Another embodiment is directed to a lighting method, comprising: coupling a plurality of lighting nodes in series to draw power from a power source, each lighting node including at least one lighting unit; and converting a nonlinear or variable current-to-voltage characteristic of the at least one lighting unit of each lighting node to a substantially linear current-to-voltage characteristic.

Another embodiment is directed to a lighting system, comprising a plurality of lighting nodes coupled in series to draw power from a power source. Each lighting node of the plurality of lighting nodes has a node voltage and comprises at least one lighting unit having a significantly nonlinear or variable current-to-voltage characteristic, and a converter circuit coupled to the at least one lighting unit to provide an operating voltage for the at least one lighting unit. Each converter circuit is configured such that respective node voltages of the plurality of lighting nodes are substantially similar over at least some range of operation when the plurality of lighting nodes draws power from the power source.

Another embodiment is directed to a lighting method, comprising: coupling a plurality of lighting nodes in series to draw power from a power source, each lighting node including at least one lighting unit; and converting a nonlinear or variable current-to-voltage characteristic of the at least one lighting unit of each lighting node such that respective node voltages of the plurality of lighting nodes are substantially similar over at least some range of operation when the plurality of lighting nodes draws power from the power source.

Another embodiment is directed to an apparatus, comprising at least one load having a first current-to-voltage characteristic, and a converter circuit coupled to the at least one load to alter the first current-to-voltage characteristic in a predetermined manner so as to facilitate a predictable behavior of the at least one load when the at least one load is connected in series with at least one other load to draw power from a power source. In one aspect, a first current conducted by the apparatus when the apparatus draws power from a power source is independent of a second current conducted by the load.

Another embodiment is directed to an apparatus, comprising at least one light source having an operating voltage $V_L$, an operating current $I_L$, and a first current-to-voltage characteristic based on the operating voltage $V_L$ and the operating current $I_L$. The apparatus further comprises a converter circuit coupled to the at least one light source to provide the operating voltage $V_L$, the converter circuit configured such that the apparatus conducts a terminal current $I_T$ and has a terminal voltage $V_T$ when the apparatus draws power from a power source. In various aspects, the operating voltage $V_L$ of the at least one light source is less than the terminal voltage $V_T$ of the apparatus, the terminal current $I_T$ of the apparatus is independent of the operating current $I_L$ or the operating voltage $V_L$ of the at least one lighting unit, the converter circuit alters the first current-to-voltage characteristic in a predetermined manner to provide a second current-to-voltage characteristic for the apparatus, based on the terminal voltage $V_T$ and the terminal current $I_T$, that is significantly different from the first current-to-voltage characteristic, and the second current-to-voltage characteristic facilitates a predictable behavior of the at least one load when the at least one load is connected in series with at least one other load to draw power from the power source.

Another embodiment is directed to a method, comprising altering a first current-to-voltage characteristic of at least one load in a predetermined manner so as to facilitate a predictable behavior of the at least one load when the at least one load is connected in series with at least one other load to draw power from a power source, wherein a first current conducted from the power source is independent of a second current conducted by the at least one load.

Another embodiment is directed to an apparatus, comprising at least one load having a nonlinear current-to-voltage characteristic, the at least one load having a plurality of operating states, and a converter circuit coupled to the at least one load and configured such that a current conduced by the apparatus when the apparatus draws power from a power source is independent of the plurality of operating states of the load.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyro-luminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "color temperature" generally is used herein in connection with white light, although this usage is not intended to limit the scope of this term. Color temperature essentially refers to a particular color content or shade (e.g., reddish, bluish) of white light. The color temperature of a given radiation sample conventionally is characterized according to the temperature in degrees Kelvin (K) of a black body radiator that radiates essentially the same spectrum as the radiation sample in question. Black body radiator color temperatures generally fall within a range of from approximately 700 degrees K (typically considered the first visible to the human eye) to over 10,000 degrees K; white light generally is perceived at color temperatures above 1500-2000 degrees K.

Lower color temperatures generally indicate white light having a more significant red component or a "warmer feel," while higher color temperatures generally indicate white light having a more significant blue component or a "cooler feel." By way of example, fire has a color temperature of approximately 1,800 degrees K, a conventional incandescent bulb has a color temperature of approximately 2848 degrees K, early morning daylight has a color temperature of approximately 3,000 degrees K, and overcast midday skies have a color temperature of approximately 10,000 degrees K. A color image viewed under white light having a color temperature of approximately 3,000 degree K has a relatively reddish tone, whereas the same color image viewed under white light having a color temperature of approximately 10,000 degrees K has a relatively bluish tone.

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

The term "addressable" is used herein to refer to a device (e.g., a light source in general, a lighting unit or fixture, a controller or processor associated with one or more light sources or lighting units, other non-lighting related devices, etc.) that is configured to receive information (e.g., data) intended for multiple devices, including itself, and to selectively respond to particular information intended for it. The term "addressable" often is used in connection with a networked environment (or a "network," discussed further below), in which multiple devices are coupled together via some communications medium or media.

In one network implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices coupled to the network each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

The term "network" as used herein refers to any interconnection of two or more devices (including controllers or processors) that facilitates the transport of information (e.g. for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

The term "user interface" as used herein refers to an interface between a human user or operator and one or more devices that enables communication between the user and the device(s). Examples of user interfaces that may be employed in various implementations of the present disclosure include, but are not limited to, switches, potentiometers, buttons, dials, sliders, a mouse, keyboard, keypad, various types of game controllers (e.g., joysticks), track balls, display screens, various types of graphical user interfaces (GUIs), touch screens, microphones and other types of sensors that may receive some form of human-generated stimulus and generate a signal in response thereto.

The following patents and patent applications are hereby incorporated herein by reference:

- U.S. Pat. No. 6,016,038, issued Jan. 18, 2000, entitled "Multicolored LED Lighting Method and Apparatus;"
- U.S. Pat. No. 6,211,626, issued Apr. 3, 2001, entitled "Illumination Components;"
- U.S. Pat. No. 6,608,453, issued Aug. 19, 2003, entitled "Methods and Apparatus for Controlling Devices in a Networked Lighting System;"
- U.S. Pat. No. 6,777,891, issued Aug. 17, 2004, entitled "Methods and Apparatus for Controlling Devices in a Networked Lighting System;"
- U.S. Pat. No. 6,967,448, issued Nov. 22, 2005, entitled "Methods and Apparatus for Controlling Illumination;"
- U.S. Pat. No. 6,975,079, issued Dec. 13, 2005, entitled "Systems and Methods for Controlling Illumination Sources;"
- U.S. Pat. No. 7,038,399, issued May 2, 2006, entitled "Methods and Apparatus for Providing Power to Lighting Devices;"
- U.S. Pat. No. 7,014,336, issued Mar. 21, 2006, entitled "Systems and Methods for Generating and Modulating Illumination Conditions;"
- U.S. Pat. No. 7,161,556, issued Jan. 9, 2007, entitled "Systems and Methods for Programming Illumination Devices;"
- U.S. Pat. No. 7,186,003, issued Mar. 6, 2007, entitled "Light-Emitting Diode Based Products;"
- U.S. Pat. No. 7,202,613, issued Apr. 10, 2007, entitled "Controlled Lighting Methods and Apparatus;"
- U.S. Pat. No. 7,233,115, issued Jun. 19, 2007, entitled "LED-Based Lighting Network Power Control Methods And Apparatus;"
- U.S. patent application Ser. No. 10/995,038, filed Nov. 22, 2004, entitled "Light System Manager;"
- U.S. patent application Ser. No. 11/225,377, filed Sep. 12, 2005, entitled "Power Control Methods and Apparatus for Variable Loads;"
- U.S. patent application Ser. No. 11/422,589, filed Jun. 6, 2006, entitled "Methods and Apparatus for Implementing Power Cycle Control of Lighting Devices based on Network Protocols;"
- U.S. patent application Ser. No. 11/429,715, filed May 8, 2006, entitled "Power Control Methods and Apparatus;" and
- U.S. patent application Ser. No. 11/325,080, filed Jan. 3, 2006, entitled "Power Allocation Methods for Lighting Devices Having Multiple Source Spectrums, and Apparatus Employing Same."

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Various aspects and embodiments of the present invention are described in detail below, including certain embodiments relating particularly to LED-based light sources. It should be appreciated, however, that the present invention is not limited to any particular manner of implementation, and that the various embodiments discussed explicitly herein are primarily for purposes of illustration. For example, the various concepts discussed herein may be suitably implemented in a variety of environments involving LED-based light sources, other types of light sources not including LEDs, environments that involve both LEDs and other types of light sources in combination, and environments that involve non-lighting-related devices alone or in combination with various types of light sources.

The present invention generally relates to inventive methods and apparatus for simulating resistive loads, as well as facilitating series, parallel, or series-parallel connections of multiple loads to draw operating power from a power source. In some implementations disclosed herein, of interest are loads that have a nonlinear and/or variable current-to-voltage characteristic. In other implementations, loads of interest may have one or more functional aspects or components that may be controlled by modulating power to the functional components. Examples of such functional components may include, but are not limited to, motors or other actuators and motorized/movable components (e.g., relays, solenoids), temperature control components (e.g. heating/cooling elements) and at least some types of light sources. Examples of power modulation control techniques that may be employed in the load to control the functional components include, but are not limited to, pulse frequency modulation, pulse width modulation, and pulse number modulation (e.g., one-bit D/A conversion).

Figure 1:
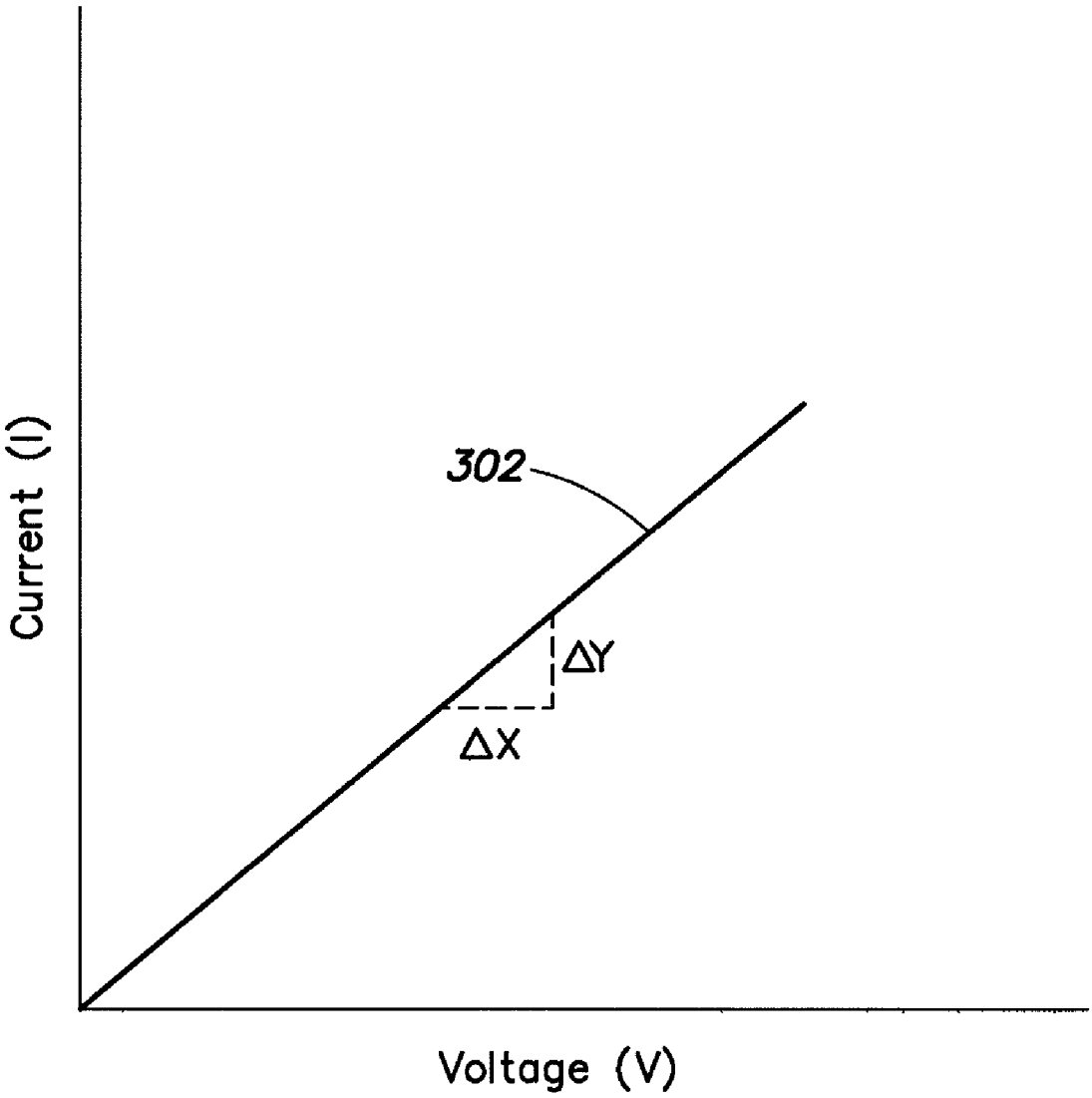
FIG. 1 illustrates a plot of a current-to-voltage characteristic for a typical resistor.

In some embodiments, inventive methods and apparatus relate to configurations, modifications and improvements that result in altered current-to-voltage characteristics associated with loads. As well known in the electrical arts, a current-to-voltage (I-V) characteristic is a plot on a graph showing the relationship between a DC current through an electronic device and the DC voltage across its terminals. FIG. 1 shows an exemplary I-V characteristic plot 302 for a resistor, in which applied voltage values are represented along a horizontal axis (x-axis), and resulting current values are represented along a vertical axis (y-axis). An I-V characteristic may be employed to determine basic parameters of a device and to model its behavior in an electrical circuit.

Perhaps the simplest example of an I-V characteristic is provided by the plot 302 for a resistor which, according to Ohm's Law ($V=I\cdot R$), results in a theoretically linear relationship between a voltage applied across the resistor and a resulting current flowing through the resistor. A plot of a linear I-V characteristic may be generally described by the relationship $I=mV+b$, where m is the slope of the plot and b is the plot's intercept along the vertical axis. In the particular case of a resistor governed by Ohm's Law, as in the plot 302 shown in FIG. 1, the intercept $b=0$ (the plot passes through the origin of the graph), and the resistance R is given by the reciprocal of the slope m (i.e., a steep slope represents a low resistance and a small slope represents a high resistance).

In various aspects of the present invention, current-to-voltage characteristics of loads may be altered in a predetermined manner so as to facilitate a predictable and/or desirable behavior of multiple loads when they are connected in series to draw operating power from a power source. In some exemplary inventive embodiments disclosed herein, the loads include or consist essentially of LED-based light sources (including one or more LEDs) or LED-based lighting units, and current-to-voltage characteristics associated with LED-based light sources or lighting units are altered in a predetermined manner so as to facilitate a predictable and/or desirable behavior of the LED-based light sources/lighting units when they are connected in series, parallel, or series-parallel arrangements to draw operating power from a power source.

Figure 2:
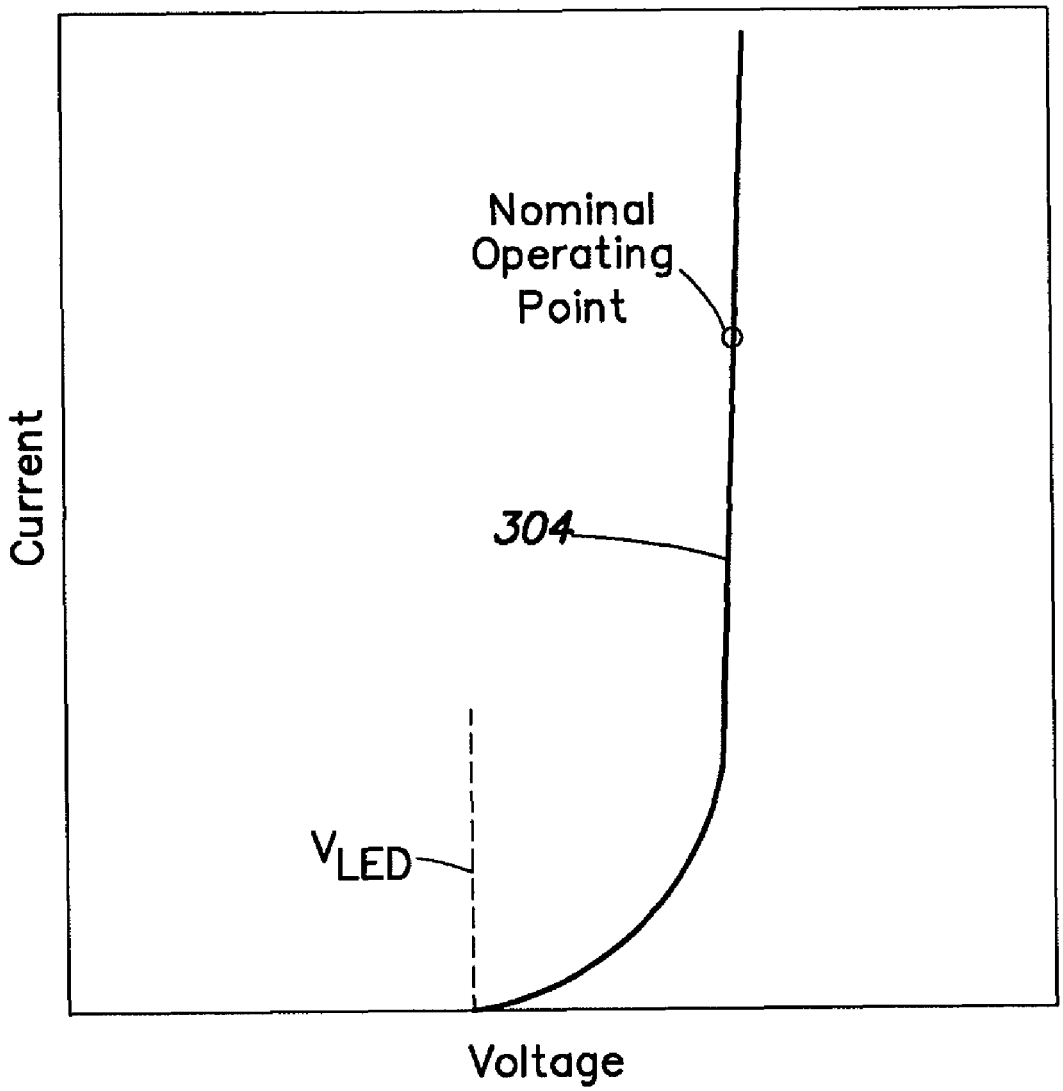
FIGS. 2 and 3 illustrate plots of current-to-voltage characteristics for a conventional LED and a conventional LED-based lighting unit, respectively.

One issue that often arises when considering the connection of multiple LEDs or LED-based lighting units to obtain operating power is that their current-to-voltage characteristics generally are significantly nonlinear or variable, i.e., they do not resemble that of a resistor. For example, the I-V characteristic of a conventional LED is approximately exponential (i.e., the current drawn by the LED is approximately an exponential function of applied voltage). Beyond a small forward bias voltage, typically in a range of from about 1.6 Volts to 3.5 Volts (depending on the color of the LED), a small change in applied voltage results in a substantial change in current through the LED. Since the LED voltage is logarithmically related to the LED current, the voltage can be considered to remain essentially constant over the LED's operating range; in this manner, LEDs are generally considered as "fixed voltage" devices. FIG. 2 illustrates an exemplary current-to-voltage characteristic plot 304 of a conventional LED, in which a nominal operating point just above the forward bias voltage $V_{LED}$ is indicated. FIG. 2 shows that within a small voltage range, the LED may conduct a wide range of current according to an approximately exponential relationship having an appreciably high or steep slope at the nominal operating point.

Because of its fixed voltage nature, the power drawn by an LED essentially is proportional to the current conducted. As the average current through (and power consumption of) an LED increases, the brightness of light generated by the LED increases, up to the maximum current handling capability of the LED. A series connection of multiple LEDs does not change the shape of the current-to-voltage characteristic shown in FIG. 2. Hence, operating one or more LEDs from a voltage source generally is impractical without one or more current limiting devices to "flatten" the I-V characteristic, as small changes in voltage have significant changes on current.

To keep LED current and power at relatively predictable levels with variations in applied voltage (as well as variations in physical characteristics amongst LEDs due to manufacturing differences, temperature changes, and other sources of forward voltage variation), a current-limiting resistor is often placed in series with an LED and then connected to a power source. This has the effect of somewhat flattening the otherwise steep slope of the I-V characteristic shown in FIG. 2, albeit in exchange for reduced efficiency (as some power inevitably is expended by the resistor and dissipated as heat). Provided there is sufficient voltage available, multiple LEDs can be connected in series with a single current-limiting resistor. The current flowing through the series combination of resistor and LED(s), however, is a function of the forward voltage(s) $V_{LED}$ of the LED(s). Stated differently, the current conducted from the power source by the series combination of resistor/LED(s) is not independent of the operating parameters (voltage, current) of the LED(s), and these operating parameters are in turn dependent on the manufacturing tolerances of the LED(s), the variability of the voltage source, and the percentage of total voltage allowed in the series resistor.

In normal operation, many conventional electrical/electronic devices draw variable current from common sources of energy, which typically provide essentially fixed and stable voltages regardless of the device's power demands. This indeed is the case for a conventional LED-based lighting unit, which may be operated to energize one or more of multiple different LEDs (or multiple different groups of LEDs) at any time, each associated with a particular current (as discussed further below in connection with FIG. 4). The current-to-voltage characteristic may thus be deemed to be "variable," in that the device may draw a variable current (e.g., multiple different currents) at a given supply voltage.

Figure 3:
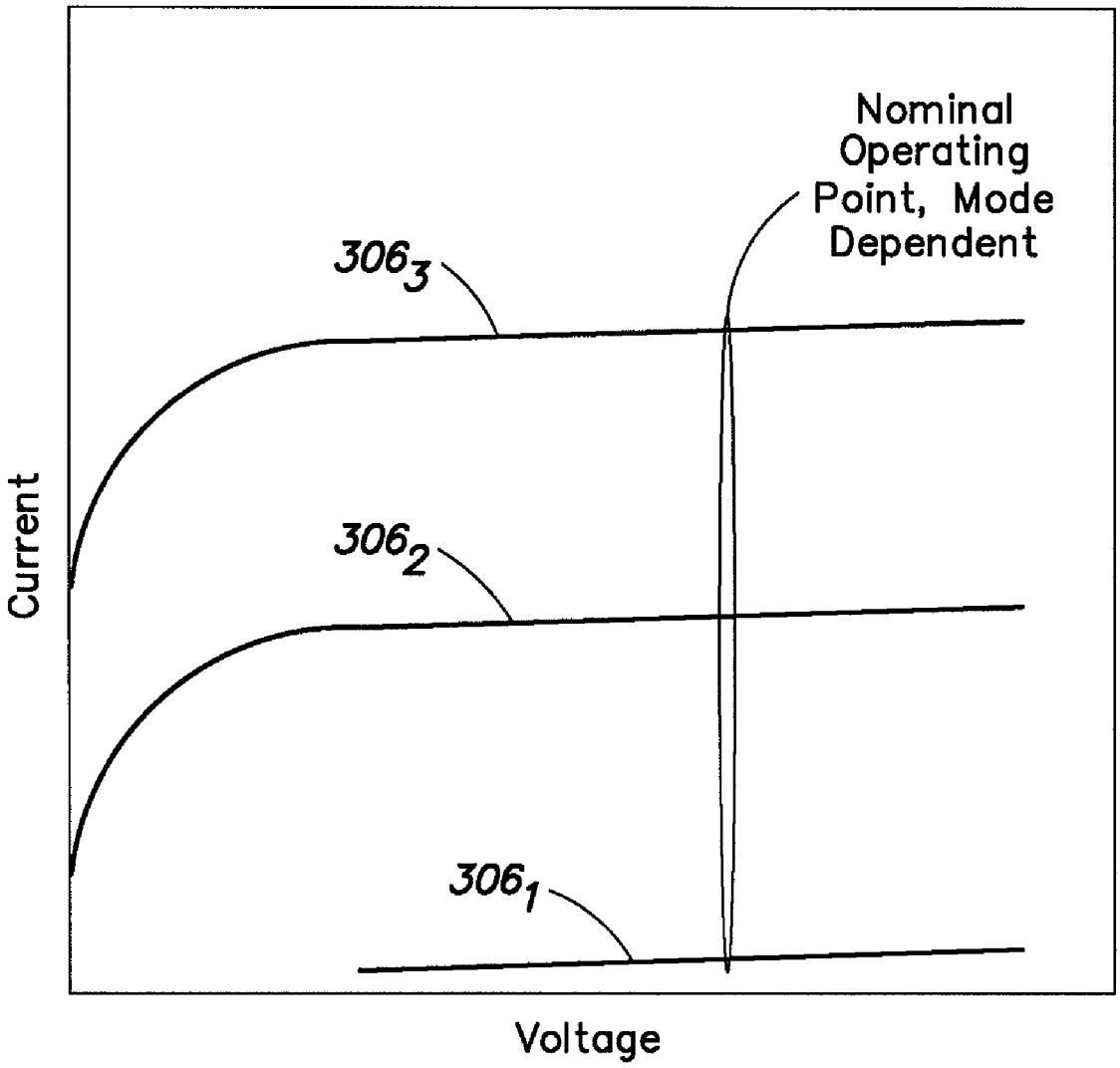

FIG. 3 illustrates an exemplary variable current-to-voltage characteristic including three plots $\mathbf{306}_1$, $\mathbf{306}_2$, and $\mathbf{306}_3$, and an exemplary nominal operating point, for a conventional LED-based lighting unit. In the example of FIG. 3, three different currents are possible at a given voltage and for each plot, a constant current source is employed to significantly flatten the I-V characteristic. Due to the constant current sources, FIG. 3 illustrates that for any given mode of operation (for each of the plots), a particularly small range of average current is drawn by the lighting unit over a wide range of applied voltages; again, however, at any given voltage, multiple different currents are possible. It should be appreciated that the three plots shown in FIG. 3 are provided primarily for purposes of illustration, and that other types of lighting units or electronic devices having multiple modes of operation may have I-V characteristics comprising multiple plots that traverse a variety of trajectories, including those with negative slopes, discontinuities, hysteresis, time variable power consumption (including all forms of modulation), etc. All of these possibilities, however, may nonetheless be represented by a region of valid voltage/current combinations, bounded by a set of maximum currents over a range of voltages.

The notably nonlinear or variable current-to-voltage characteristics illustrated in FIGS. 2 and 3 generally are not conducive particularly to a series power interconnection of such loads, as voltage sharing amongst loads with such nonlinear I-V characteristics is unpredictable. Accordingly, in various embodiments of the present invention, altered current-to-voltage characteristics cause a load to appear as a substantially linear or "resistive" element (e.g., behave similarly to a resistor), at least over some operating range, to a power source from which the load draws power. In particular, loads including LED-based light sources and/or LED-based lighting units can be modified to function as substantially linear or resistive elements, at least over some operating range, when they draw power from a power source. This, in turn, facilitates a series power connection of the modified LED-based light sources or lighting units, in which the voltage across each modified light source/lighting unit is relatively more predictable; i.e., the terminal voltage of a power source from which the series connection is drawing power is shared in a more predictable (e.g., equal) manner amongst the modified light sources/lighting units. By simulating a resistive load, such modified loads also may be connected in parallel, or various series-parallel arrangement, with predictable results with respect to terminal currents and voltages.

For purposes of the present disclosure, a substantially linear or "resistive" element is one whose current-to-voltage characteristic over at least some designated operating range (i.e., range of applied voltages) has an essentially constant slope; stated differently, an "effective resistance" $R_{eff}$ of the element remains essentially constant over the designated operating range, wherein the effective resistance is given by the reciprocal of the slope of the I-V characteristic plot over the designated operating range. An "apparent resistance" $R_{app}$ of the element within the designated operating range is given by the ratio of a particular terminal voltage $V_T$ applied to the element and a corresponding terminal current $I_T$ drawn by the element, i.e., $R_{app}=V_T/I_T$. According to various implementations discussed further below, loads having nonlinear or variable I-V characteristics may be modified (e.g., combined with additional circuitry) such that the resulting apparatus has an effective resistance $R_{eff}$ at some nominal operating point $V_T=V_{nom}$ (or over some range of operation) of between approximately $0.1(R_{app})$ to $10.0(R_{app})$. In yet other implementations, loads may be modified such that the resulting apparatus has an effective resistance at some nominal operating point (or over some range of operation) of between approximately $R_{app}$ to $4(R_{app})$. In some implementations, a desired current-to-voltage characteristic may be substantially linear significantly beyond a particular range of operation around a nominal operating point; however, in other implementations, the voltage range for which the current-to-voltage characteristic is substantially linear around the nominal operating point need not be very large.

Figure 4:
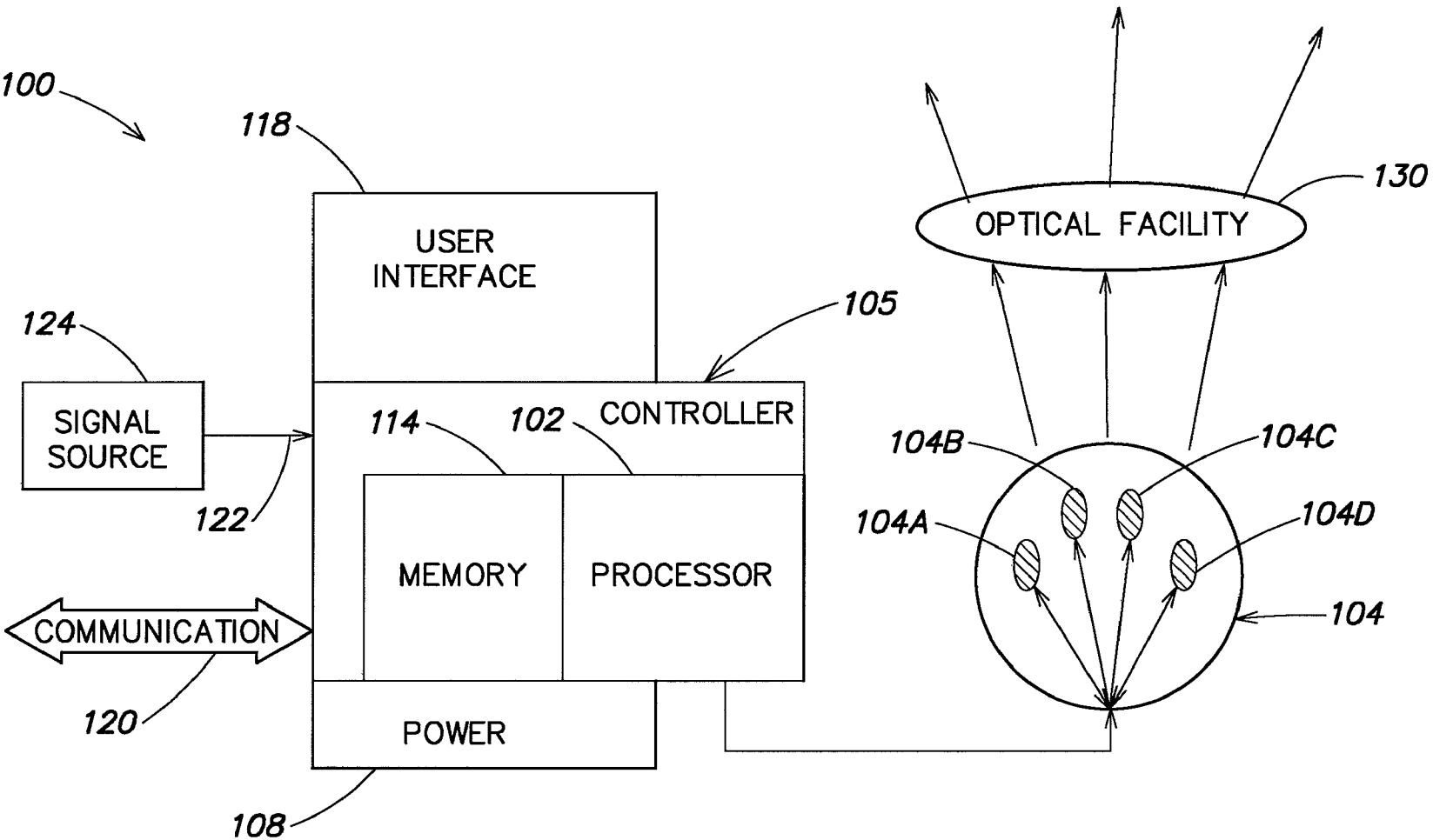
FIG. 4 is a generalized block diagram illustrating an LED-based lighting unit suitable for use with an apparatus for facilitating a series connection of multiple loads according to various embodiments of the present invention.
Figure 5:
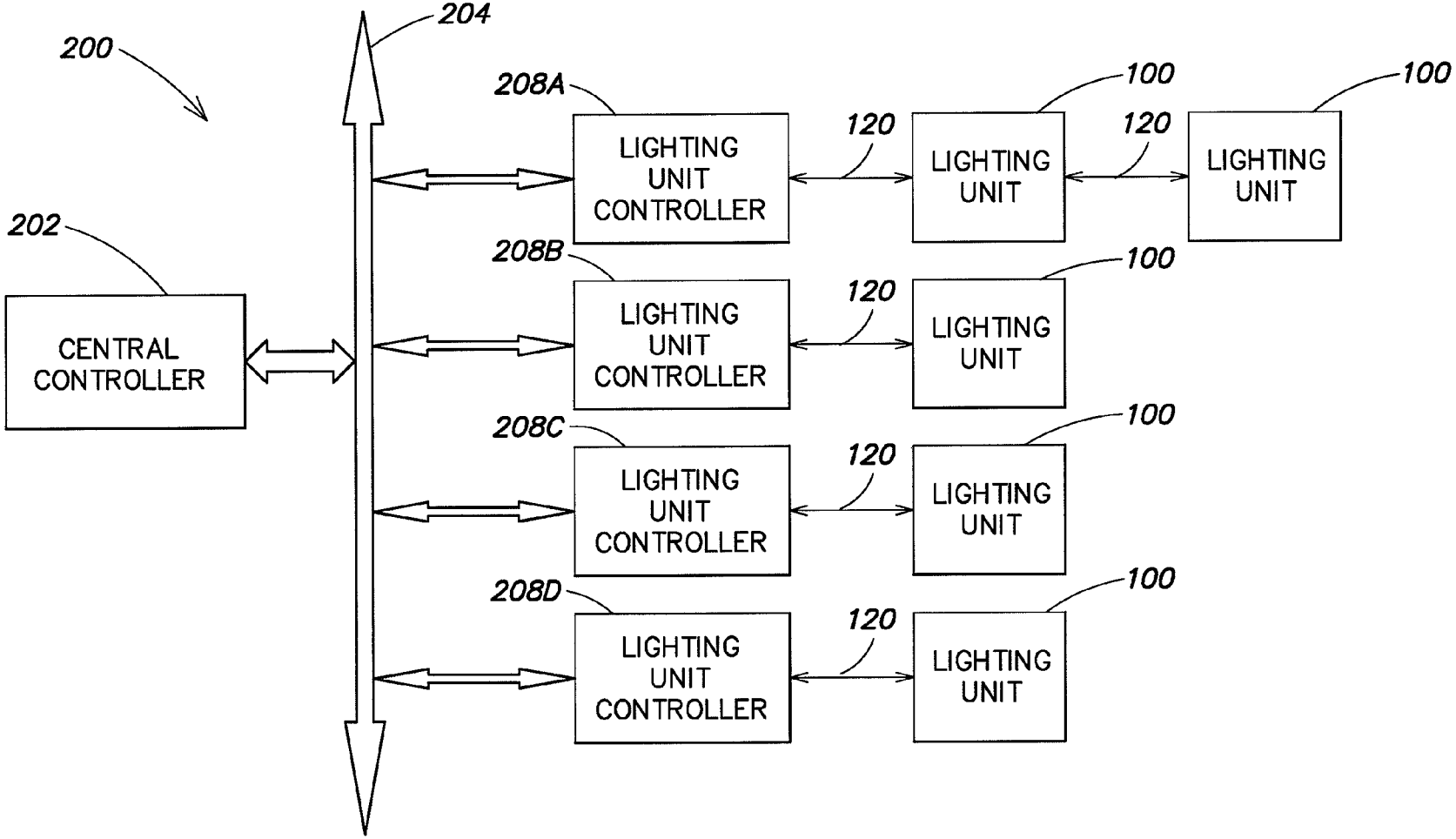
FIG. 5 is a generalized block diagram illustrating a networked lighting system of LED-based lighting units of FIG. 4.

To facilitate a discussion of altered current-to-voltage characteristics associated with loads according to embodiments of the present invention, a particular example of a load comprising a conventional LED-based lighting unit that may be modified as contemplated by the invention, as well as systems or networks of such lighting units, are discussed first in connection with FIGS. 4 and 5. Various methods and apparatus for altering the current-to-voltage characteristic of the exemplary LED-based lighting unit, as well as other types of loads, are then discussed in connection with the subsequent Figures.

FIG. 4 illustrates one example of an LED-based lighting unit 100. Various implementations of LED-based lighting units similar to those described below in connection with FIG. 4 may be found, for example, in U.S. Pat. Nos. 6,016,038, and 6,211,626, both hereby incorporated herein by reference.

In various embodiments of the present invention, the lighting unit 100 shown in FIG. 4 may be used alone or together with other similar lighting units in a system of lighting units (e.g., as discussed further below in connection with FIG. 5). Used alone or in combination with other lighting units, the lighting unit 100 may be employed in a variety of applications including, but not limited to, direct-view or indirect-view interior or exterior space (e.g., architectural) lighting and illumination in general, direct or indirect illumination of objects or spaces, theatrical or other entertainment-based/special effects lighting, decorative lighting, safety-oriented lighting, vehicular lighting, lighting associated with, or illumination of, displays and/or merchandise (e.g. for advertising and/or in retail/consumer environments), combined lighting or illumination and communication systems, etc., as well as for various indication, display and informational purposes.

Additionally, one or more lighting units similar to that described in connection with FIG. 4 may be implemented in a variety of products including, but not limited to, various forms of light modules or bulbs having various shapes and electrical/mechanical coupling arrangements (including replacement or "retrofit" modules or bulbs adapted for use in conventional sockets or fixtures), as well as a variety of consumer and/or household products (e.g., night lights, toys, games or game components, entertainment components or systems, utensils, appliances, kitchen aids, cleaning products, etc.) and architectural components (e.g., lighted panels for walls, floors, ceilings, lighted trim and ornamentation components, etc.).

Referring to FIG. 4, the lighting unit 100 includes one or more light sources 104A, 104B, 104C, and 104D (shown collectively as 104), wherein one or more of the light sources may be an LED-based light source that includes one or more LEDs. Any two or more of the light sources may be adapted to generate radiation of different colors (e.g. red, green, blue); in this respect, as discussed above, each of the different color light sources generates a different source spectrum that constitutes a different "channel" of a "multi-channel" lighting unit. Although FIG. 4 shows four light sources 104A, 104B, 104C, and 104D, it should be appreciated that the lighting unit is not limited in this respect, as different numbers and various types of light sources (all LED-based light sources, LED-based and non-LED-based light sources in combination, etc.) adapted to generate radiation of a variety of different colors, including essentially white light, may be employed in the lighting unit 100, as discussed further below.

Still referring to FIG. 4, the lighting unit 100 also includes a controller 105 configured to output one or more control signals to drive the light sources so as to generate various intensities of light from the light sources. For example, in one implementation, the controller 105 may be configured to output at least one control signal for each light source so as to independently control the intensity of light (e.g., radiant power in lumens) generated by each light source; alternatively, the controller 105 may be configured to output one or more control signals to collectively control a group of two or more light sources identically. Some examples of control signals that may be generated by the controller to control the light sources include, but are not limited to, pulse modulated signals, pulse width modulated signals (PWM), pulse amplitude modulated signals (PAM), pulse code modulated signals (PCM) analog control signals (e.g., current control signals, voltage control signals), combinations and/or modulations of the foregoing signals, or other control signals. In some versions, particularly in connection with LED-based sources, one or more modulation techniques provide for variable control using a fixed current level applied to one or more LEDs, so as to mitigate potential undesirable or unpredictable variations in LED output that may arise if a variable LED drive current were employed. In other versions, the controller 105 may control other dedicated circuitry (not shown in FIG. 4) which in turn controls the light sources so as to vary their respective intensities.

In general, the intensity (radiant output power) of radiation generated by the one or more light sources is proportional to the average power delivered to the light source(s) over a given time period. Accordingly, one technique for varying the intensity of radiation generated by the one or more light sources involves modulating the power delivered to (i.e., the operating power of) the light source(s). For some types of light sources, including LED-based sources, this may be accomplished effectively using a pulse width modulation (PWM) technique.

In one exemplary implementation of a PWM control technique, for each channel of a lighting unit a fixed predetermined voltage $V_{source}$ is applied periodically across a given light source constituting the channel. The application of the voltage $V_{source}$ may be accomplished via one or more switches, not shown in FIG. 4, controlled by the controller 105. While the voltage $V_{source}$ is applied across the light source, a predetermined fixed current $I_{source}$ (e.g., determined by a current regulator, also not shown in FIG. 4) is allowed to flow through the light source. Again, recall that an LED-based light source may include one or more LEDs, such that the voltage $V_{source}$ may be applied to a group of LEDs constituting the source, and the current $I_{source}$ may be drawn by the group of LEDs. The fixed voltage $V_{source}$ across the light source when energized, and the regulated current $I_{source}$ drawn by the light source when energized, determines the amount of instantaneous operating power $P_{source}$ of the light source ($P_{source}=V_{source}\cdot I_{source}$). As mentioned above, for LED-based light sources, using a regulated current mitigates potential undesirable or unpredictable variations in LED output that may arise if a variable LED drive current were employed.

According to the PWM technique, by periodically applying the voltage $V_{source}$ to the light source and varying the time the voltage is applied during a given on-off cycle, the average power delivered to the light source over time (the average operating power) may be modulated. In particular, the controller 105 may be configured to apply the voltage $V_{source}$ to a given light source in a pulsed fashion (e.g., by outputting a control signal that operates one or more switches to apply the voltage to the light source), preferably at a frequency that is greater than that capable of being detected by the human eye (e.g., greater than approximately 100 Hz). In this manner, an observer of the light generated by the light source does not perceive the discrete on-off cycles (commonly referred to as a "flicker effect"), but instead the integrating function of the eye perceives essentially continuous light generation. By adjusting the pulse width (i.e. on-time, or "duty cycle") of on-off cycles of the control signal, the controller varies the average amount of time the light source is energized in any given time period, and hence varies the average operating power of the light source. In this manner, the perceived brightness of the generated light from each channel in turn may be varied.

As discussed in greater detail below, the controller 105 may be configured to control each different light source channel of a multi-channel lighting unit at a predetermined average operating power to provide a corresponding radiant output power for the light generated by each channel. Alternatively, the controller 105 may receive instructions (e.g., "lighting commands") from a variety of origins, such as a user interface 118, a signal source 124, or one or more communication ports 120, that specify prescribed operating powers for one or more channels and, hence, corresponding radiant output powers for the light generated by the respective channels. By varying the prescribed operating powers for one or more channels (e.g., pursuant to different instructions or lighting commands), different perceived colors and brightness levels of light may be generated by the lighting unit.

In one embodiment of the lighting unit 100, as mentioned above, one or more of the light sources 104A, 104B, 104C, and 104D shown in FIG. 4 may include a group of multiple LEDs or other types of light sources (e.g., various parallel and/or serial connections of LEDs or other types of light sources) that are controlled together by the controller 105. Additionally, it should be appreciated that one or more of the light sources may include one or more LEDs that are adapted to generate radiation having any of a variety of spectra (i.e., wavelengths or wavelength bands), including, but not limited to, various visible colors (including essentially white light), various color temperatures of white light, ultraviolet, or infrared. LEDs having a variety of spectral bandwidths (e.g., narrow band, broader band) may be employed in various implementations of the lighting unit 100.

The lighting unit 100 may be constructed and arranged to produce a wide range of variable color radiation. For example, in some embodiments, the lighting unit 100 may be particularly arranged such that controllable variable intensity (i.e., variable radiant power) light generated by two or more of the light sources combines to produce a mixed colored light (including essentially white light having a variety of color temperatures). In particular, the color (or color temperature) of the mixed colored light may be varied by varying one or more of the respective intensities (output radiant power) of the light sources, e.g., in response to one or more control signals output by the controller 105. Furthermore, the controller 105 may be particularly configured to provide control signals to one or more of the light sources so as to generate a variety of static or time-varying (dynamic) multi-color (or multi-color temperature) lighting effects. To this end, in various embodiments of the invention, the controller includes a processor 102 (e.g., a microprocessor) programmed to provide such control signals to one or more of the light sources. The processor 102 may be programmed to provide such control signals autonomously, in response to lighting commands, or in response to various user or signal inputs.

Thus, the lighting unit 100 may include a wide variety of colors of LEDs in various combinations, including two or more of red, green, and blue LEDs to produce a color mix, as well as one or more other LEDs to create varying colors and color temperatures of white light. For example, red, green and blue can be mixed with amber, white, UV, orange, IR or other colors of LEDs. Additionally, multiple white LEDs having different color temperatures (e.g., one or more first white LEDs that generate a first spectrum corresponding to a first color temperature, and one or more second white LEDs that generate a second spectrum corresponding to a second color temperature different than the first color temperature) may be employed, in an all-white LED lighting unit or in combination with other colors of LEDs. Such combinations of differently colored LEDs and/or different color temperature white LEDs in the lighting unit 100 can facilitate accurate reproduction of a host of desirable spectrums of lighting conditions, examples of which include, but are not limited to, a variety of outside daylight equivalents at different times of the day, various interior lighting conditions, lighting conditions to simulate a complex multicolored background, and the like. Other desirable lighting conditions can be created by removing particular pieces of spectrum that may be specifically absorbed, attenuated or reflected in certain environments. Water, for example tends to absorb and attenuate most non-blue and non-green colors of light, so underwater applications may benefit from lighting conditions that are tailored to emphasize or attenuate some spectral elements relative to others.

As also shown in FIG. 4, in various embodiments, the lighting unit 100 may include a memory 114 to store various items of information. For example, the memory 114 may be employed to store one or more lighting commands or programs for execution by the processor 102 (e.g., to generate one or more control signals for the light sources), as well as various types of data useful for generating variable color radiation (e.g., calibration information, discussed further below). The memory 114 also may store one or more particular identifiers (e.g., a serial number, an address, etc.) that may be used either locally or on a system level to identify the lighting unit 100. Such identifiers may be pre-programmed by a manufacturer, for example, and may be either alterable or non-alterable thereafter (e.g., via some type of user interface located on the lighting unit, via one or more data or control signals received by the lighting unit, etc.). Alternatively, such identifiers may be determined at the time of initial use of the lighting unit in the field, and again may be alterable or non-alterable thereafter.

Still referring to FIG. 4, the lighting unit 100 may also include one or more user interfaces 118 to facilitate any of a number of user-selectable settings or functions (e.g., generally controlling the light output of the lighting unit 100, changing and/or selecting various pre-programmed lighting effects to be generated by the lighting unit, changing and/or selecting various parameters of selected lighting effects, setting particular identifiers such as addresses or serial numbers for the lighting unit, etc.). In various embodiments, the communication between the user interface 118 and the lighting unit may be accomplished through wire or cable, or wireless transmission.

In one implementation, the controller 105 of the lighting unit monitors the user interface 118 and controls one or more of the light sources 104A, 104B, 104C and 104D based at least in part on a user's operation of the interface. For example, the controller 105 may be configured to respond to operation of the user interface by originating one or more control signals for controlling one or more of the light sources. Alternatively, the processor 102 may be configured to respond by selecting one or more pre-programmed control signals stored in memory, modifying control signals generated by executing a lighting program, selecting and executing a new lighting program from memory, or otherwise affecting the radiation generated by one or more of the light sources.

In one particular implementation, the user interface 118 constitutes one or more switches (e.g., a standard wall switch) that interrupt power to the controller 105. In one version of this implementation, the controller 105 is configured to monitor the power as controlled by the user interface, and in turn control one or more of the light sources based at least in part on duration of a power interruption caused by operation of the user interface. As discussed above, the controller may be particularly configured to respond to a predetermined duration of a power interruption by, for example, selecting one or more pre-programmed control signals stored in memory, modifying control signals generated by executing a lighting program, selecting and executing a new lighting program from memory, or otherwise affecting the radiation generated by one or more of the light sources.

Still referring to FIG. 4, the lighting unit 100 may be configured to receive one or more signals 122 from one or more other signal sources 124. The controller 105 of the lighting unit may use the signal(s) 122, either alone or in combination with other control signals (e.g., signals generated by executing a lighting program, one or more outputs from a user interface, etc.), so as to control one or more of the light sources 104A, 104B, 104C and 104D in a manner similar to that discussed above in connection with the user interface.

Examples of the signal(s) 122 that may be received and processed by the controller 105 include, but are not limited to, one or more audio signals, video signals, power signals, various types of data signals, signals representing information obtained from a network (e.g., the Internet), signals representing one or more detectable/sensed conditions, signals from lighting units, signals consisting of modulated light, etc. In various implementations, the signal source(s) 124 may be located remotely from the lighting unit 100, or included as a component of the lighting unit. In one embodiment, a signal from one lighting unit 100 could be sent over a network to another lighting unit 100.

Some examples of a signal source 124 that may be employed in, or used in connection with, the lighting unit 100 of FIG. 4 include any of a variety of sensors or transducers that generate one or more signals 122 in response to some stimulus. Examples of such sensors include, but are not limited to, various types of environmental condition sensors, such as thermally sensitive (e.g., temperature, infrared) sensors, humidity sensors, motion sensors, photosensors/light sensors (e.g., photodiodes, sensors that are sensitive to one or more particular spectra of electromagnetic radiation such as spectroradiometers or spectrophotometers, etc.), various types of cameras, sound or vibration sensors or other pressure/force transducers (e.g., microphones, piezoelectric devices), and the like.

Additional examples of a signal source 124 include various metering/detection devices that monitor electrical signals or characteristics (e.g., voltage, current, power, resistance, capacitance, inductance, etc.) or chemical/biological characteristics (e.g., acidity, a presence of one or more particular chemical or biological agents, bacteria, etc.) and provide one or more signals 122 based on measured values of the signals or characteristics. Yet other examples of a signal source 124 include various types of scanners, image recognition systems, voice or other sound recognition systems, artificial intelligence and robotics systems, and the like. A signal source 124 could also be a lighting unit 100, another controller or processor, or any one of many available signal generating devices, such as media players, MP3 players, computers, DVD players, CD players, television signal sources, camera signal sources, microphones, speakers, telephones, cellular phones, instant messenger devices, SMS devices, wireless devices, personal organizer devices, and many others.

Further, the lighting unit 100 shown in FIG. 4 may also include one or more optical elements or facilities 130 to optically process the radiation generated by the light sources 104A, 104B, 104C, and 104D. For example, one or more optical elements may be configured so as to change one or both of a spatial distribution and a propagation direction of the generated radiation. In particular, one or more optical elements may be configured to change a diffusion angle of the generated radiation. One or more optical elements 130 may be particularly configured to variably change one or both of a spatial distribution and a propagation direction of the generated radiation (e.g., in response to some electrical and/or mechanical stimulus). Examples of optical elements that may be included in the lighting unit 100 include, but are not limited to, reflective materials, refractive materials, translucent materials, filters, lenses, mirrors, and fiber optics. The optical element 130 also may include a phosphorescent material, luminescent material, or other material capable of responding to or interacting with the generated radiation.

As also shown in FIG. 4, the lighting unit 100 may include one or more communication ports 120 to facilitate coupling of the lighting unit 100 to any of a variety of other devices, including one or more other lighting units. For example, one or more communication ports 120 may facilitate coupling multiple lighting units together as a networked lighting system, in which at least some or all of the lighting units are addressable (e.g., have particular identifiers or addresses) and/or are responsive to particular data transported across the network. One or more communication ports 120 may also be adapted to receive and/or transmit data through wired or wireless transmission. In one embodiment, information received through the communication port may at least in part relate to address information to be subsequently used by the lighting unit, and the lighting unit may be adapted to receive and then store the address information in the memory 114 (e.g., the lighting unit may be adapted to use the stored address as its address for use when receiving subsequent data via one or more communication ports).

In particular, in a networked lighting system environment, as discussed in greater detail further below (e.g., in connection with FIG. 5), as data is communicated via the network, the controller 105 of each lighting unit coupled to the network may be configured to be responsive to particular data (e.g., lighting control commands) that pertain to it (e.g., in some cases, as dictated by the respective identifiers of the networked lighting units). Once a given controller identifies particular data intended for it, it may read the data and, for example, change the lighting conditions produced by its light sources according to the received data (e.g., by generating appropriate control signals to the light sources). The memory 114 of each lighting unit coupled to the network may be loaded, for example, with a table of lighting control signals that correspond with data the processor 102 of the controller receives. In these implementations, once the processor 102 receives data from the network, it then consult the table to select the control signals that correspond to the received data, and control the light sources of the lighting unit accordingly (e.g., using any one of a variety of analog or digital signal control techniques, including various pulse modulation techniques discussed above).

In many embodiments, the processor 102 of a given lighting unit, whether or not coupled to a network, is configured to interpret lighting instructions/data that are received in a DMX protocol (as discussed, for example, in U.S. Pat. Nos. 6,016,038 and 6,211,626), which is a lighting command protocol conventionally employed in the lighting industry for some programmable lighting applications. In the DMX protocol, lighting instructions are transmitted to a lighting unit as control data that is formatted into packets including 512 bytes of data, in which each data byte is constituted by 8-bits representing a digital value of between zero and 255. These 512 data bytes are preceded by a "start code" byte. An entire "packet" including 513 bytes (start code plus data) is transmitted serially at 250 kbit/s pursuant to RS-485 voltage levels and cabling practices, wherein the start of a packet is signified by a break of at least 88 microseconds.

In the DMX protocol, each data byte of the 512 bytes in a given packet is intended as a lighting command for a particular "channel" of a multi-channel lighting unit, wherein a digital value of zero indicates no radiant output power for a given channel of the lighting unit (i.e., channel off), and a digital value of 255 indicates full radiant output power (100% available power) for the given channel of the lighting unit (i.e., channel full on). For example, in one aspect, considering for the moment a three-channel lighting unit based on red, green and blue LEDs (i.e., an "R-G-B" lighting unit), a lighting command in DMX protocol may specify each of a red channel command, a green channel command, and a blue channel command as eight-bit data (i.e., a data byte) representing a value from 0 to 255. The maximum value of 255 for any one of the color channels instructs the processor 102 to control the corresponding light source(s) to operate at maximum available power (i.e., 100%) for the channel, thereby generating the maximum available radiant power for that color (such a command structure for an R-G-B lighting unit commonly is referred to as 24-bit color control). Hence, a command of the format [R, G, B]=[255, 255, 255] would cause the lighting unit to generate maximum radiant power for each of red, green and blue light (thereby creating white light).

Thus, a given communication link employing the DMX protocol conventionally can support up to 512 different lighting unit channels. A given lighting unit designed to receive communications formatted in the DMX protocol generally is configured to respond to only one or more particular data bytes of the 512 bytes in the packet corresponding to the number of channels of the lighting unit (e.g., in the example of a three-channel lighting unit, three bytes are used by the lighting unit), and ignore the other bytes, based on a particular position of the desired data byte(s) in the overall sequence of the 512 data bytes in the packet. To this end, DMX-based lighting units may be equipped with an address selection mechanism that may be manually set by a user/installer to determine the particular position of the data byte(s) that the lighting unit responds to in a given DMX packet.

It should be appreciated, however, that lighting units suitable for purposes of the present disclosure are not limited to a DMX command format, as lighting units according to various embodiments may be configured to be responsive to other types of communication protocols/lighting command formats so as to control their respective light sources. In general, the processor 102 may be configured to respond to lighting commands in a variety of formats that express prescribed operating powers for each different channel of a multi-channel lighting unit according to some scale representing zero to maximum available operating power for each channel.

For example, in other embodiments, the processor 102 of a given lighting unit is configured to interpret lighting instructions/data that are received in a conventional Ethernet protocol (or similar protocol based on Ethernet concepts). Ethernet is a well-known computer networking technology often employed for local area networks (LANs) that defines wiring and signaling requirements for interconnected devices forming the network, as well as frame formats and protocols for data transmitted over the network. Devices coupled to the network have respective unique addressess, and data for one or more addressable devices on the network is organized as packets. Each Ethernet packet includes a "header" that specifies a destination address (to where the packet is going) and a source address (from where the packet came), followed by a "payload" including several bytes of data (e.g., in Type II Ethernet frame protocol, the payload may be from 46 data bytes to 1500 data bytes). A packet concludes with an error correction code or "checksum." As with the DMX protocol discussed above, the payload of successive Ethernet packets destined for a given lighting unit configured to receive communications in an Ethernet protocol may include information that represents respective prescribed radiant powers for different available spectra of light (e.g., different color channels) capable of being generated by the lighting unit.

In yet another embodiment, the processor 102 of a given lighting unit may be configured to interpret lighting instructions/data that are received in a serial-based communication protocol as described, for example, in U.S. Pat. No. 6,777,891. In particular, according to one embodiment based on a serial-based communication protocol, multiple lighting units 100 are coupled together via their communication ports 120 to form a series connection of lighting units (e.g., a daisy-chain or ring topology), wherein each lighting unit has an input communication port and an output communication port. Lighting instructions/data transmitted to the lighting units are arranged sequentially based on a relative position in the series connection of each lighting unit. It should be appreciated that while a lighting network based on a series interconnection of lighting units is discussed particularly in connection with an embodiment employing a serial-based communication protocol, the disclosure is not limited in this respect, as other examples of lighting network topologies contemplated by the present disclosure are discussed further below in connection with FIG. 5.

In some exemplary implementations of the embodiment employing a serial-based communication protocol, as the processor 102 of each lighting unit in the series connection receives data, it "strips off" or extracts one or more initial portions of the data sequence intended for it and transmits the remainder of the data sequence to the next lighting unit in the series connection. For example, again considering a serial interconnection of multiple three-channel (e.g., "R-G-B") lighting units, three multi-bit values (one multi-bit value per channel) are extracted by each three-channel lighting unit from the received data sequence. Each lighting unit in the series connection in turn repeats this procedure, namely, stripping off or extracting one or more initial portions (multi-bit values) of a received data sequence and transmitting the remainder of the sequence. The initial portion of a data sequence stripped off in turn by each lighting unit may include respective prescribed radiant powers for different available spectra of light (e.g., different color channels) capable of being generated by the lighting unit. As discussed above in connection with the DMX protocol, in various implementations each multi-bit value per channel may be an 8-bit value, or other number of bits (e.g., 12, 16, 24, etc.) per channel, depending in part on a desired control resolution for each channel.

In yet another exemplary implementation of a serial-based communication protocol, rather than stripping off an initial portion of a received data sequence, a flag is associated with each portion of a data sequence representing data for multiple channels of a given lighting unit, and an entire data sequence for multiple lighting units is transmitted completely from lighting unit to lighting unit in the serial connection. As a lighting unit in the serial connection receives the data sequence, it looks for the first portion of the data sequence in which the flag indicates that a given portion (representing one or more channels) has not yet been read by any lighting unit. Upon finding such a portion, the lighting unit reads and processes the portion to provide a corresponding light output, and sets the corresponding flag to indicate that the portion has been read. Again, the entire data sequence is transmitted completely from lighting unit to lighting unit, wherein the state of the flags indicate the next portion of the data sequence available for reading and processing.

In one particular embodiment relating to a serial-based communication protocol, the controller 105 a given lighting unit configured for a serial-based communication protocol may be implemented as an application-specific integrated circuit (ASIC) designed to specifically process a received stream of lighting instructions/data according to the "data stripping/extraction" process or "flag modification" process discussed above. More specifically, in one exemplary embodiment of multiple lighting units coupled together in a series interconnection to form a network, each lighting unit includes an ASIC-implemented controller 105 having the functionality of the processor 102, the memory 114 and communication port(s) 120 shown in FIG. 4 (optional user interface 118 and signal source 124 of course need not be included in some implementations). Such an implementation is discussed in detail in U.S. Pat. No. 6,777,891.

The lighting unit 100 of FIG. 4 may include and/or be coupled to one or more power sources 108. In various embodiments, examples of power source(s) 108 include, but are not limited to, AC power sources, DC power sources, batteries, solar-based power sources, thermoelectric or mechanical-based power sources and the like. Additionally, the power source(s) 108 may include or be associated with one or more power conversion devices or power conversion circuitry (e.g., in some cases internal to the lighting unit 100) that convert power received by an external power source to a form suitable for operation of the various internal circuit components and light sources of the lighting unit 100.

The controller 105 of the lighting unit 100 may be configured to accept a standard A.C. line voltage from the power source 108 and provide appropriate D.C. operating power for the light sources and other circuitry of the lighting unit based on concepts related to DC-DC conversion, or "switching" power supply concepts, as discussed in U.S. Pat. No. 7,233,115 and co-pending U.S. patent application Ser. No. 11/429,715. In some versions of these implementations, the controller 105 may include circuitry to not only accept a standard A.C. line voltage but to ensure that power is drawn from the line voltage with a significantly high power factor.

While not shown explicitly in FIG. 4, the lighting unit 100 may be implemented in any one of several different structural configurations according to various embodiments of the present disclosure. Examples of such configurations include, but are not limited to, an essentially linear or curvilinear configuration, a circular configuration, an oval configuration, a rectangular configuration, combinations of the foregoing, various other geometrically shaped configurations, various two or three dimensional configurations, and the like.

A given lighting unit also may have any one of a variety of mounting arrangements for the light source(s), enclosure/housing arrangements and shapes to partially or fully enclose the light sources, and/or electrical and mechanical connection configurations. In particular, in some implementations, a lighting unit may be configured as a replacement or "retrofit" to engage electrically and mechanically in a conventional socket or fixture arrangement (e.g., an Edison-type screw socket, a halogen fixture arrangement, a fluorescent fixture arrangement, etc.).

Additionally, one or more optical elements as discussed above may be partially or fully integrated with an enclosure/housing arrangement for the lighting unit. Furthermore, the various components of the lighting unit discussed above (e.g., processor, memory, power, user interface, etc.), as well as other components that may be associated with the lighting unit in different implementations (e.g., sensors/transducers, other components to facilitate communication to and from the unit, etc.) may be packaged in a variety of ways; for example, any subset or all of the various lighting unit components, as well as other components that may be associated with the lighting unit, may be packaged together. Packaged subsets of components may be coupled together electrically and/or mechanically in a variety of manners.

FIG. 5 illustrates an example of a networked lighting system 200 according to various embodiments of the present invention, wherein a number of lighting units 100, similar to those discussed above in connection with FIG. 4, are coupled together to form the networked lighting system. It should be appreciated, however, that the particular configuration and arrangement of lighting units shown in FIG. 5 is for purposes of illustration only, and that the present invention is not limited to the particular system topology shown in FIG. 5.

Additionally, while not shown explicitly in FIG. 5, it should be appreciated that the networked lighting system 200 may be configured flexibly to include one or more user interfaces, as well as one or more signal sources such as sensors/transducers. For example, one or more user interfaces and/or one or more signal sources such as sensors/transducers (as discussed above in connection with FIG. 4) may be associated with any one or more of the lighting units of the networked lighting system 200. Alternatively (or in addition to the foregoing), one or more user interfaces and/or one or more signal sources may be implemented as "stand alone" components in the networked lighting system 200. Whether stand alone components or particularly associated with one or more lighting units 100, these devices may be "shared" by the lighting units of the networked lighting system. Stated differently, one or more user interfaces and/or one or more signal sources such as sensors/transducers may constitute "shared resources" in the networked lighting system that may be used in connection with controlling any one or more of the lighting units of the system.

Referring to FIG. 5, in some embodiments, the lighting system 200 includes one or more lighting unit controllers (hereinafter "LUCs") 208A, 208B, 208C, and 208D, wherein each LUC is responsible for communicating with and generally controlling one or more lighting units 100 coupled to it. Although FIG. 5 illustrates two lighting units 100 coupled to the LUC 208A, and one lighting unit 100 coupled to each LUC 208B, 208C and 208D, it should be appreciated that the invention is not limited in this respect, as different numbers of lighting units 100 may be coupled to a given LUC in a variety of different configurations (serially connections, parallel connections, combinations of serial and parallel connections, etc.) using a variety of different communication media and protocols.

In the system of FIG. 5, each LUC in turn may be coupled to a central controller 202 that is configured to communicate with one or more LUCs. Although FIG. 5 shows four LUCs coupled to the central controller 202 via a generic connection 204 (which may include any number of a variety of conventional coupling, switching and/or networking devices), it should be appreciated that according to various embodiments, different numbers of LUCs may be coupled to the central controller 202. Additionally, according to various embodiments of the present invention, the LUCs and the central controller may be coupled together in a variety of configurations using a variety of different communication media and protocols to form the networked lighting system 200. Moreover, it should be appreciated that the interconnection of LUCs and the central controller, and the interconnection of lighting units to respective LUCs, may be accomplished in different manners (e.g., using different configurations, communication media, and protocols).

For example, the central controller 202 shown in FIG. 5 may by configured to implement Ethernet-based communications with the LUCs, and in turn the LUCs may be configured to implement one of Ethernet-based, DMX-based, or serial-based protocol communications with the lighting units 100 (as discussed above, exemplary serial-based protocols suitable for various network implementation are discussed in detail in U.S. Pat. No. 6,777,891. In particular, in one particular embodiment, each LUC may be configured as an addressable Ethernet-based controller and accordingly may be identifiable to the central controller 202 via a particular unique address (or a unique group of addresses and/or other identifiers) using an Ethernet-based protocol. In this manner, the central controller 202 may be configured to support Ethernet communications throughout the network of coupled LUCs, and each LUC may respond to those communications intended for it. In turn, each LUC may communicate lighting control information to one or more lighting units coupled to it, for example, via an Ethernet, DMX, or serial-based protocol, in response to the Ethernet communications with the central controller 202 (wherein the lighting units are appropriately configured to interpret information received from the LUC in the Ethernet, DMX, or serial-based protocols).

The LUCs 208A, 208B, and 208C shown in FIG. 5 may be configured to be "intelligent" in that the central controller 202 may be configured to communicate higher level commands to the LUCs that need to be interpreted by the LUCs before lighting control information can be forwarded to the lighting units 100. For example, a lighting system operator may want to generate a color-changing effect that varies colors from lighting unit to lighting unit in such a way as to generate the appearance of a propagating rainbow of colors ("rainbow chase"), given a particular placement of lighting units with respect to one another. In this example, the operator may provide a simple instruction to the central controller 202 to accomplish this, and in turn the central controller may communicate to one or more LUCs using an Ethernet-based protocol high level command to generate a "rainbow chase." The command may contain timing, intensity, hue, saturation or other relevant information, for example. When a given LUC receives such a command, it may then interpret the command and communicate further commands to one or more lighting units using any one of a variety of protocols (e.g., Ethernet, DMX, serial-based), in response to which the respective sources of the lighting units are controlled via any of a variety of signaling techniques (e.g., PWM).

Further, one or more LUCs of a lighting network may be coupled to a series connection of multiple lighting units 100 (e.g., see LUC 208A of FIG. 5, which is coupled to two series-connected lighting units 100). In one embodiment, each LUC coupled in this manner is configured to communicate with the multiple lighting units using a serial-based communication protocol, examples of which were discussed above. More specifically, in one exemplary implementation, a given LUC may be configured to communicate with a central controller 202, and/or one or more other LUCs, using an Ethernet-based protocol, and in turn communicate with the multiple lighting units using a serial-based communication protocol. In this manner, a LUC may be viewed in one sense as a protocol converter that receives lighting instructions or data in the Ethernet-based protocol, and passes on the instructions to multiple serially-connected lighting units using the serial-based protocol. Of course, in other network implementations involving DMX-based lighting units arranged in a variety of possible topologies, it should be appreciated that a given LUC similarly may be viewed as a protocol converter that receives lighting instructions or data in the Ethernet protocol, and passes on instructions formatted in a DMX protocol.

It should again be appreciated that the foregoing example of using multiple different communication implementations (e.g., Ethernet/DMX) in a lighting system according to one embodiment of the present invention is for purposes of illustration only, and that the invention is not limited to this particular example.

From the foregoing, it may be appreciated that one or more lighting units as discussed above are capable of generating highly controllable variable color light over a wide range of colors, as well as variable color temperature white light over a wide range of color temperatures.

According to various embodiments of the present invention, a current-to-voltage (I-V) characteristic associated with the exemplary lighting unit 100 discussed above in connection with FIGS. 4 and 5 may be altered to resemble a resistive load, and thereby facilitate particularly a series connection of such lighting units to draw power from a power source. As discussed above, a typical current-to-voltage characteristic for the lighting unit 100 is illustrated in FIG. 3, in which it may be observed that at any given operating voltage, multiple currents are possible (i.e., the current-to-voltage characteristic is variable). The notably variable current-to-voltage characteristic illustrated in FIG. 3, as well as the nonlinear I-V characteristic shown in FIG. 2 for a conventional LED, generally are not conducive to a series power interconnection of such loads, as voltage sharing amongst loads with such nonlinear I-V characteristics is unpredictable.

Thus, pursuant to inventive methods and apparatus according to some embodiments discussed further below, current-to-voltage characteristics of loads may be altered in a predetermined manner so as to facilitate a predictable and/or desirable behavior of the loads when they are connected in series, parallel, or series-parallel arrangements to draw operating power from a power source. For example, altered current-to-voltage characteristics may cause a load with a nonlinear or variable I-V characteristic to appear as a substantially linear or resistive element (e.g., behave similarly to a resistor), at least over some operating range, to a power source from which the load draws power. In some inventive embodiments disclosed herein, nonlinear loads such as LED-based light sources (e.g., LEDs 104) or variable loads such as LED-based lighting units (e.g., the lighting unit 100) are modified to function as substantially linear or resistive elements, at least over some operating range, when they draw power from a power source.

A substantially linear I-V characteristic facilitates a series power connection of modified loads in which the terminal voltage across each modified load is relatively more predictable; stated differently, the overall terminal voltage of a power source from which the series connection is drawing power is divided more predictably amongst the individual terminal voltages of the respective loads (the overall terminal voltage of the power source may be shared essentially equally amongst the modified loads). A series connection of loads also can permit the use of higher voltages to provide operating power to the loads, and may also allow operation of groups of loads without requiring a transformer between a source of power (e.g., wall power or line voltage such as 120 VAC or 240 VAC) and the loads. In various examples discussed further below, series or series/parallel interconnections of multiple modified loads (e.g., LED-based light sources or LED-based lighting units) configured according to the concepts disclosed herein may be operated directly from an AC line voltage or mains without any reduction or other transformation of voltage levels (i.e., with only an intervening rectifier and filter capacitor).

As discussed above in connection with FIG. 5 (see the lighting units 100 coupled to the LUC 208A), an LED-based lighting unit may be configured to receive a source of operating power (e.g., a DC voltage) in parallel with other lighting units, while at the same time being configured to receive data based on a serial data interconnection and protocol (as described, for example, in U.S. Pat. No. 6,777,891). According to various concepts discussed in further detail below, such lighting units may be modified so that they also may be interconnected in series to draw operating power. It should be appreciated, however, that in the discussion below, the disclosed inventive concepts are generally applicable to other types of lighting units (and other types of non-lighting related loads) beyond the specific examples of LED-based lighting units disclosed earlier herein and in various patent and patent applications incorporated herein by reference.

Figure 6:
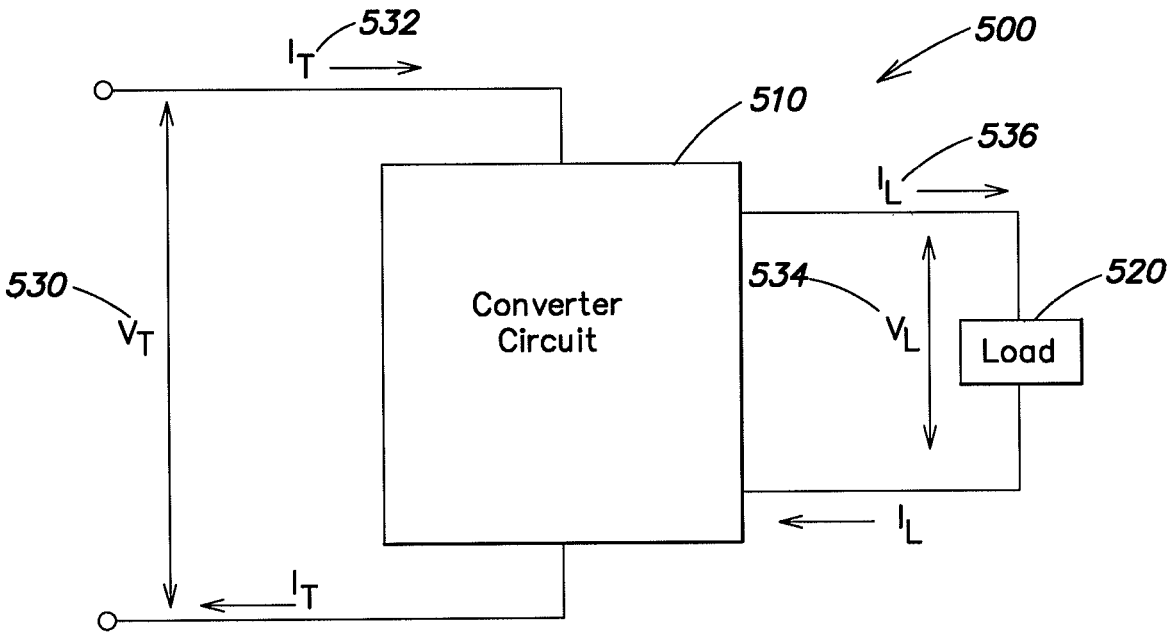
FIG. 6 is a generalized block diagram of an exemplary apparatus for altering a current-to-voltage characteristic of a load, according to some embodiments of the present invention.

FIG. 6 is a generalized block diagram of an apparatus 500 for altering a current-to-voltage characteristic of a load 520, according to many embodiments of the present invention. Referring to FIG. 6, the apparatus 500 includes the load 520, having a first current-to-voltage characteristic based on a load current 536 (designated as $I_L$ in the drawings) that is drawn when a load voltage 534 (designated as $V_L$ in the drawings) is applied across the load 520. In some versions of this embodiment, the first current-to-voltage characteristic associated with the load 520 may be significantly nonlinear or variable (e.g., as discussed above in connection with FIGS. 2 and 3). The load 520 may include or consist essentially of an LED-based light source (e.g., one or more LEDs 104) or and LED-based lighting unit (e.g., the lighting unit 100 shown in FIG. 4).

The apparatus 500 of FIG. 6 also includes a converter circuit 510 coupled to the load 520, for providing the load voltage $V_L$. The converter circuit 510 (and hence the apparatus 500) draws a terminal current 532 ($I_T$) and has a terminal voltage 530 ($V_T$) when the apparatus draws power from a power source (not shown in FIG. 6). The load current $I_L$ passes in some fashion through the converter circuit 510 and, in this manner, the load 520 draws power from the power source via the terminal voltage $V_T$. By virtue of the converter circuit 510, the apparatus 500 has a second current-to-voltage characteristic, based on the terminal current $I_T$ and the terminal voltage $V_T$, that is substantially different than the first current-to-voltage characteristic associated with the load 520. In many implementations, the load voltage $V_L$ generally is less than the terminal voltage $V_T$. Also, the terminal current $I_T$ may be independent of the load current $I_L$ or the load voltage $V_L$. Further, the second current-to-voltage characteristic associated with the apparatus 500 may be substantially linear over at least some range of operation around a nominal operating point (e.g., some range of terminal voltages $V_T$ around a nominal terminal voltage $V_T=V_{nom}$).

Figure 7:
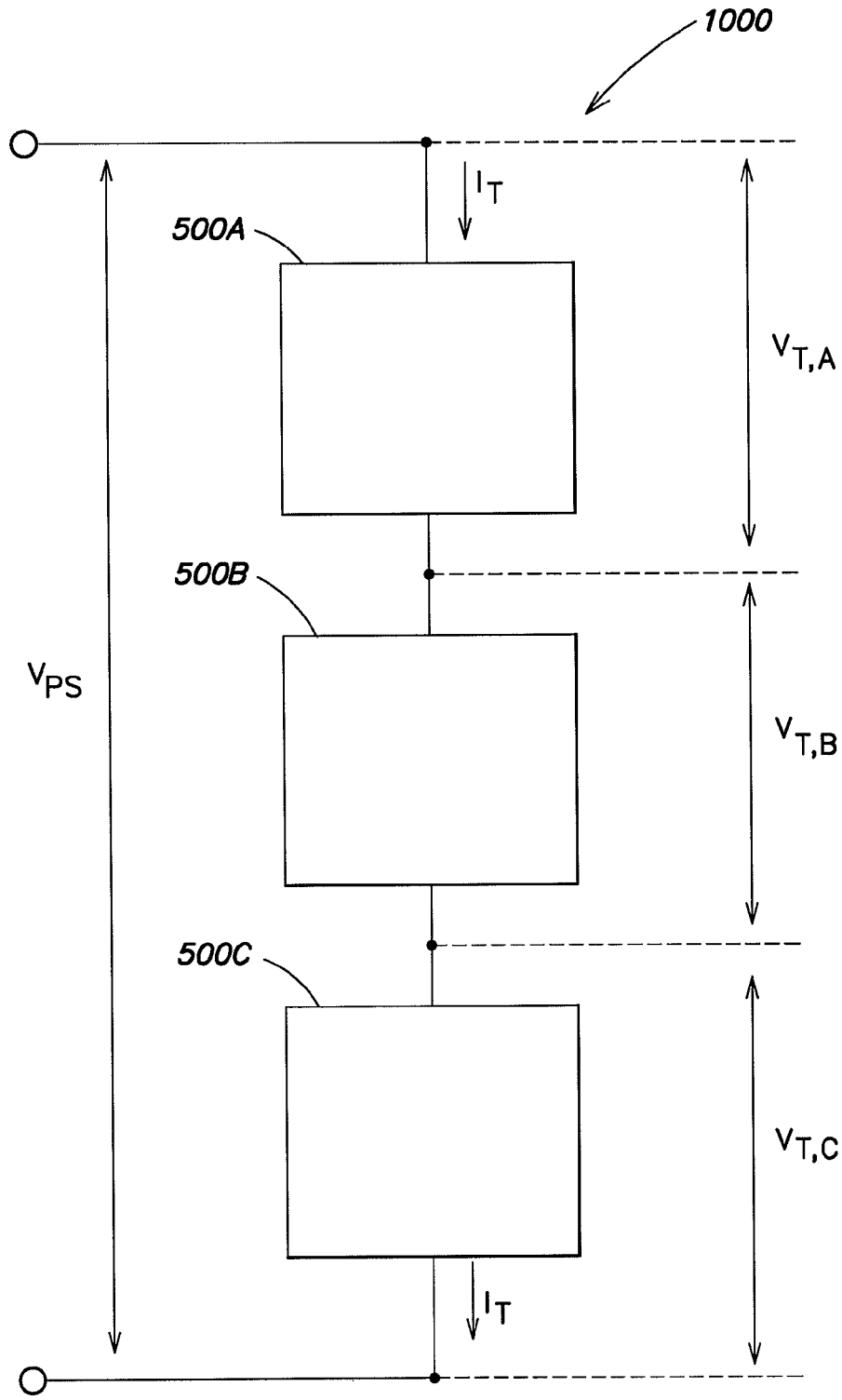
FIG. 7 illustrates a system including a plurality of apparatus of FIG. 6 connected in series.

FIG. 7 is a generalized block diagram illustrating a system 1000 including a plurality of series connected apparatus for altering a current-to-voltage characteristic of a load similar to the apparatus 500 shown in FIG. 6. While the system of FIG. 7 is depicted to include three apparatus 500A, 500B and 500C, it should be appreciated that the system is not limited in this respect, as different numbers of apparatus may be connected in series to form the system 1000. As in FIG. 6, in various implementations, the respective loads of the apparatus 500A, 500B and 500C shown in FIG. 7 are LED-based light sources or LED-based lighting units, as also discussed below in connection with FIGS. 24, 25 and 26. Each apparatus 500A, 500B and 500C constitutes a "node" of the system 1000, and the plurality of nodes are coupled in series to draw power from a power source (not shown in FIG. 6) having a power source terminal voltage $V_{PS}$. The individual terminal voltages associated with the respective nodes (or "node voltages") are labeled in FIG. 7 as $V_{T,A}$, $V_{T,B}$ and $V_{T,C}$, which when summed together equal the power source's terminal voltage $V_{PS}$. The series connection conducts the terminal current $I_T$ which flows similarly through each of the apparatus. In some embodiments, the converter circuit of each node is configured such that the respective node voltages of the plurality of lighting nodes are substantially similar or essentially identical over at least some range of operation when the system is coupled to the power source's terminal voltage.

Still referring to FIGS. 6 and 7, three conditions are posited for a series power connection of the apparatus or nodes; namely, (i) the current drawn by each node should be independent of its load's current, voltage, or operating state; (ii) the current drawn by each node should be at least somewhat proportional to the node voltage above some minimum voltage of interest (and over some anticipated operating range); iii) the current-to-voltage characteristics of respective nodes should be substantially similar or identical. Stated differently, the current-to-voltage characteristic of each node or apparatus 500 should be substantially linear such that the node/apparatus appears as a resistive element, and the current-to-voltage characteristics of all the nodes should be substantially similar.

Figure 8:
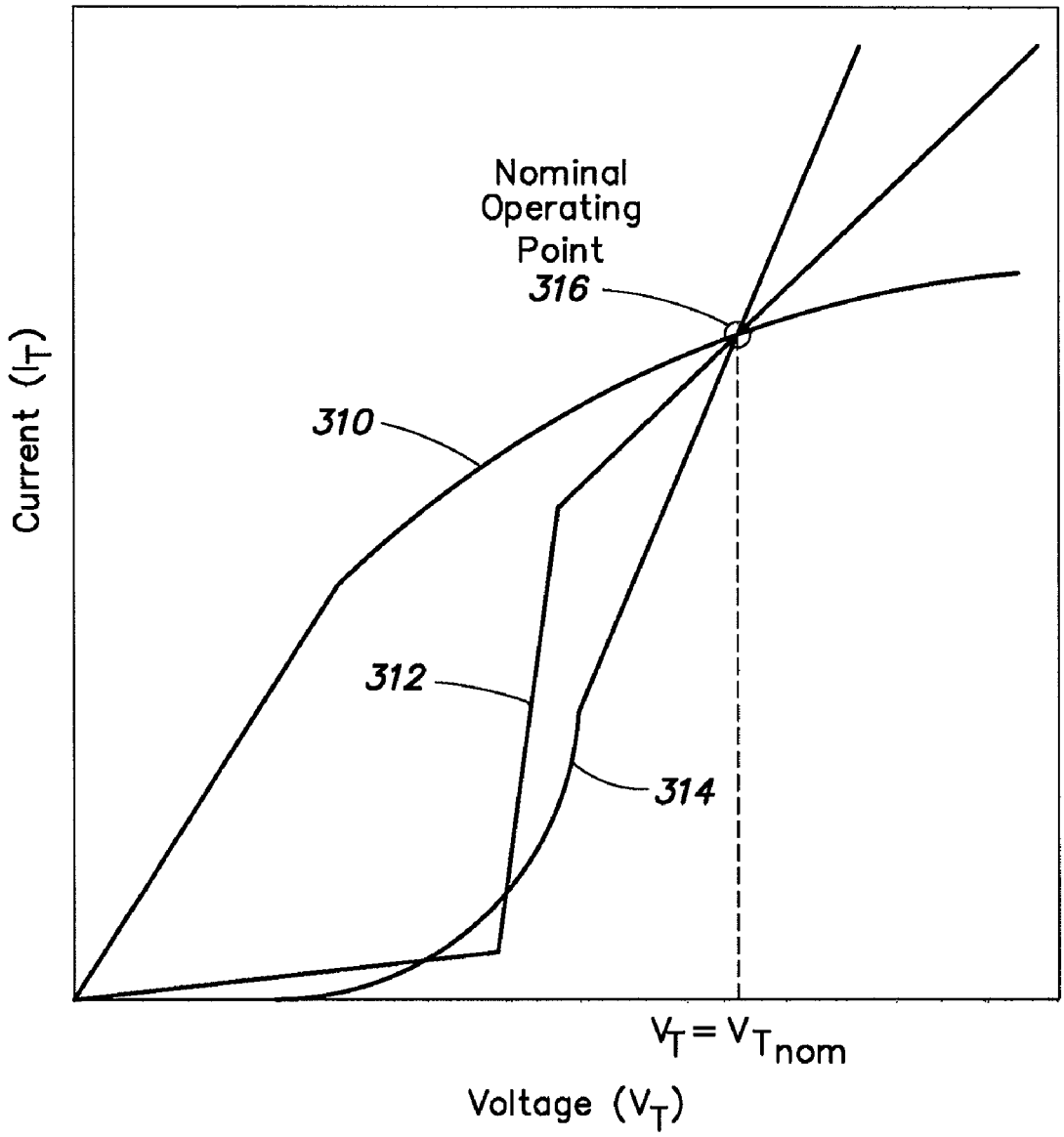
FIG. 8 illustrates plots of exemplary current-to-voltage characteristics contemplated for the apparatus of FIGS. 6 and 7.

In view of the foregoing, FIG. 8 illustrates plots 310, 312 and 314 of exemplary current-to-voltage characteristics contemplated for the apparatus 500 shown in FIGS. 6 and 7, according to various embodiments of the invention. In the plots of FIG. 8, a nominal operating point 316 is indicated, around which the current-to-voltage characteristics appear substantially linear (i.e., around some terminal voltage $V_T=V_{nom}$ for a given apparatus, the apparatus appears to be essentially "resistive"). It should be appreciated that in some implementations, a current-to-voltage characteristic contemplated for the apparatus 500 need not be precisely linear, as long as it is substantially similar or identical for series-connected apparatus. For example, although the plots 312 and 314 in FIG. 8 exhibit linear I-V characteristics around the nominal operating point, the plot 310 exhibits an I-V characteristic that has some slight curvature; for purposes of the present disclosure, however, the plot 310 represents a substantially linear I-V characteristic around the nominal operating point 316, as long as such a characteristic is shared identically by multiple series-connected apparatus to ensure predictable behavior (e.g., voltage sharing).

With reference to the plots shown in FIG. 8, an "effective resistance" of an apparatus associated with any one of the plots is given by the reciprocal of a slope of the plot over a range of voltages around a nominal operating point $V_T=V_{nom}$ for the apparatus. It should be appreciated that the effective resistance of an apparatus may be different than an "apparent resistance" $R_{app}$ of the apparatus at any given point over the range of voltages, wherein the apparent resistance is given by the ratio of a terminal voltage $V_T$ applied to the element and a corresponding terminal current $I_T$ drawn by the element, i.e., $R_{app}=V_T/I_T$. According to various implementations discussed further below, an apparatus 500 may be configured to have an effective resistance $R_{eff}$ at some nominal operating point $V_T=V_{nom}$ (or over some range of operation) of between approximately $0.1(R_{app})$ to $10.0(R_{app})$. In yet other implementations, the apparatus may be configured to have an effective resistance at some nominal operating point (or over some range of operation) of between approximately $R_{app}$ to $4(R_{app})$.

Figure 9:
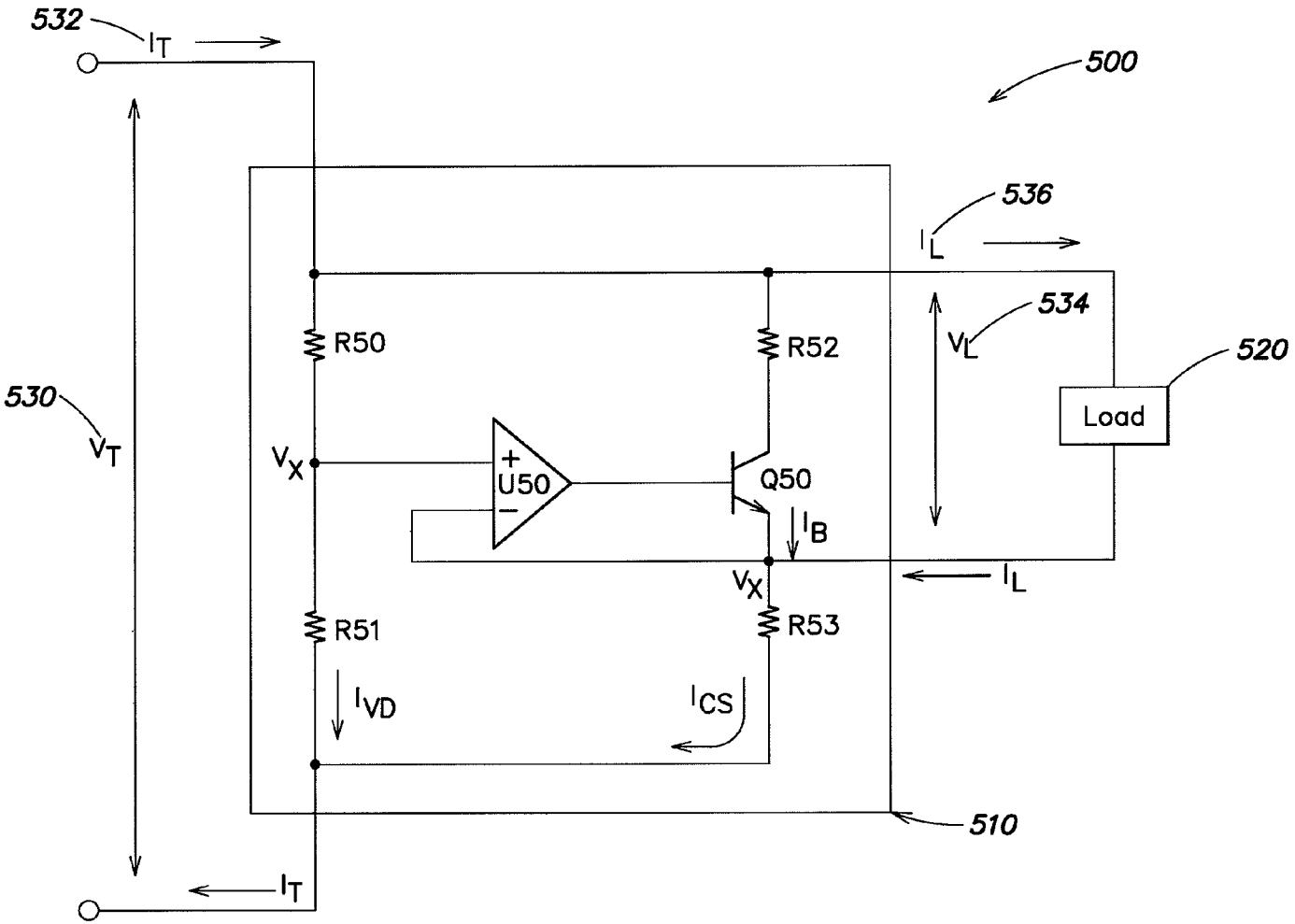
FIG. 9 is a circuit diagram of a converter circuit suitable for the apparatus of FIG. 6, according to one embodiment of the present invention.

FIG. 9 is a circuit diagram showing an example of the converter circuit 510 of the apparatus 500 shown in FIG. 6, according to one embodiment of the present invention. Referring to FIG. 9, the converter circuit 510 is implemented as a variable current source, in which control of the current flowing through the current source is based on a control voltage that is proportional to the terminal voltage $V_T$. More specifically, resistors R50 and R51 form a voltage divider to provide the control voltage $V_X$ based on the terminal voltage $V_T$. The control voltage $V_X$ is applied to the non-inverting input of operational amplifier U50, which reproduces the control voltage $V_X$ across the resistor R53; hence, the current $I_{CS}$ flowing through the current source is given by $V_X$/R53. A current $I_{VD}$ also flows through the voltage divider formed by R50 and R51, and adds to $I_{CS}$ to arrive at the terminal current $I_T$ conducted by the apparatus 500.

The current $I_{CS}$ is chosen to be greater than the maximum current $I_{L,MAX}$ that can be drawn by the load 520. The current path formed by transistor Q50 and resistor R52 provides the balance of the current ($I_B$) that adds to the load current $I_L$ to arrive at the current $I_{CS}$. The load voltage $V_L$ is given by the terminal voltage $V_T$ minus the control voltage $V_X$. With variations in an applied terminal voltage $V_T$, the load voltage $V_L$ also varies and hence the load current $I_L$ varies, based on the current-to-voltage characteristic of the load. Additionally, for loads having variable I-V characteristics, the load current $I_L$ may vary at a given $V_L$ and $V_T$. As the load current $I_L$ varies, the current flowing through Q50 and resistor R52 also varies such that the total current $I_{CS}$ flowing through the current source is proportional to $V_X$ (via R53). In this manner, the terminal current $I_T$ conducted by the apparatus remains proportional to the terminal voltage $V_T$ and independent of the load current $I_L$ (at least over some operating range in which the transistor Q50 is conducting current). In particular, with transistor Q50 conducting, the current $I_T$ may be given by:

$$I_T = \frac{V_T}{R50 + R51} + \frac{V_X}{R53} \tag{1}$$

$$V_X = V_T\left(\frac{R51}{R50 + R51}\right)$$

$$I_T = V_T\left(\frac{1 + \frac{R51}{R53}}{R50 + R51}\right).$$

Figure 10:
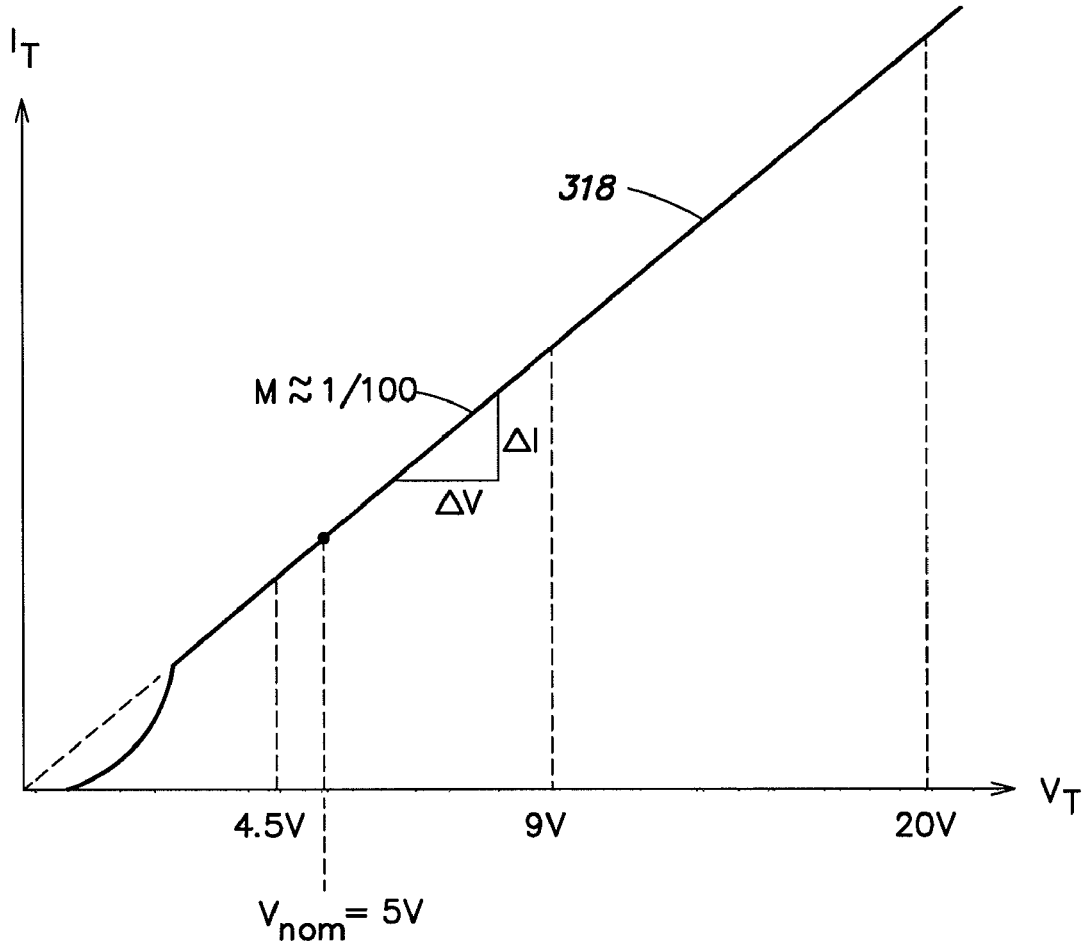
FIG. 10 illustrates a plot of a current-to-voltage characteristic for the apparatus of FIG. 9.

FIG. 10 illustrates a plot 318 of a current-to-voltage characteristic for the apparatus 500 shown in FIG. 9. As shown in FIG. 10, above some threshold voltage at which the transistor Q50 begins to conduct, the plot is substantially linear. According to Eqs. (1) above, the linear portion of the plot has a zero intercept on the vertical axis (i.e., $I_T=mV_T+b$, where b=0) and in this manner identically simulates a resistive load having an I-V characteristic that intercepts the origin. The effective resistance $R_{eff}$ of the apparatus in this region of the plot is the inverse of the slope, given by:

$$R_{eff} = \frac{1}{m} = \frac{R50 + R51}{1 + \frac{R51}{R53}}. \tag{2}$$

The apparatus illustrated in FIG. 9 may be configured to operate based on a variety of possible terminal voltages $V_T$ and nominal load voltages $V_L$. Due to the origin intercept (or "zero intercept") of the extended linear portion of the I-V characteristic shown in FIG. 10, it should be appreciated that the effective resistance of the apparatus and its apparent resistance over the linear portion are identical (i.e., $R_{eff}=R_{app}$).

Generally speaking, for practical design implementations, a minimum terminal voltage greater than a minimum load voltage at which the load is able to function properly is chosen as a nominal operating point for the apparatus ($V_T=V_{nom}>V_{L,MIN}$). The apparent resistance of the apparatus at this nominal operating point is then dictated by a maximum expected terminal current corresponding to a maximum load current $I_{L,MAX}$ that the load could require for proper operation at the nominal operating point. Thus, in some exemplary implementations, a reasonable guideline for the apparent resistance of the apparatus at the nominal operating point is given by the minimum load voltage divided by the maximum load current. In the embodiment of FIG. 9, this in turn also provides a guideline for the effective resistance $R_{eff}$, and thus the selection of component values for the various circuit elements.

For example, in one implementation based on the circuit of FIG. 9, a minimum load voltage $V_L$ is taken to be approximately 4.5 Volts, and a maximum load current $I_L$ is taken to be approximately 45 milliamps (if the load is the lighting unit 100 of FIG. 4, the maximum load current would be given by the upper-most plot $\mathbf{306}_3$ in FIG. 3). This provides a guideline for an effective resistance of approximately 100 Ohms. Based on these exemplary parameters, a nominal terminal voltage $V_T=V_{nom}=5$ Volts is chosen, and a current $I_{CS}$ flowing through the current source is set at approximately 50 milliamps, to ensure the adequate provision of maximum load current when required. The current $I_{CS}$ can be provided, for example, by setting the control voltage $V_X$ to 0.3 Volts, and selecting the resistor R53 to be 6 Ohms. Based on Eq. (2) and a target effective resistance of approximately 100 Ohms, this control voltage $V_X=0.3$ Volts in turn may be provided by selecting R50 to be 4700 Ohms and R51 to be 300 Ohms. With these resistance values, a current of approximately 1 milliamp flows through the voltage divider formed by R50 and R51, and adds to the current $I_{CS}=50$ milliamps to arrive at a terminal current $I_T$ of approximately 51 milliamps at a terminal voltage of 5 Volts, resulting in an apparent/effective resistance at the nominal operating point of 98 Ohms (i.e., approximately 100 Ohms) in the linear region of the I-V characteristic plot.

From FIG. 10, in which parameters specific to the example above are used for purposes of illustration, it may be observed that this particular implementation of the circuit of FIG. 9 may operate over a range of terminal voltages from approximately 2 Volts to approximately 20 Volts while providing a substantially linear current-to-voltage characteristic (i.e., the I-V characteristic may be linear over a 10:1 voltage range), and more particularly over a range of terminal voltages from approximately 4.5 Volts to 9 Volts. In some implementations, depending on the choice of operational amplifier, the circuit may exhibit the stated effective resistance at terminal voltages in a range of from the minimum voltage needed to operate the operational amplifier up to a voltage limited by the power dissipation and voltage capabilities of the other circuit devices and the load. However, it should be appreciated that in some applications, the range of terminal voltages over which the I-V characteristic for the apparatus 500 remains substantially linear need not be large, as the actual terminal voltage during operation in a given implementation may not vary appreciably. In yet other implementations, the apparatus may be configured (e.g., component values selected) such that the terminal voltage of the apparatus is not substantially greater than the load voltage, so as to balance the linearity achieved by the apparatus with efficiency (i.e., to reduce excess power dissipation by the converter circuit beyond that of the load itself).

In the circuit of FIG. 9, the resistor R52 may be optional and may be selected, if necessary, to ensure an appropriate collector-emitter voltage for the transistor Q50; in the present example, at a load voltage $V_L$ of 4.5 Volts, the resistor R52 may be omitted. Additionally, it should be appreciated that while the transistor Q50 is shown in FIG. 9 as a BJT, the circuit of FIG. 9 may alternatively employ an FET for Q50 to facilitate an integrated circuit implementation. Also, it should be noted that the converter circuit of FIG. 9 does not include any energy storage components, further facilitating an integrated circuit implementation. In one exemplary implementation based on FIG. 9, with reference to FIG. 4, the load 520 may comprise an LED-based lighting unit similar to the lighting unit 100 shown in FIG. 4, wherein the LED-based lighting unit comprises one or more LEDs 104 and control circuitry for the LED(s) (e.g., the controller 105). In some versions of this implementation, the converter circuit 510 and the control circuitry for the LED(s) (e.g., the controller 105) may be implemented as a single integrated circuit to which the LED(s) is/are coupled.

Figure 11:
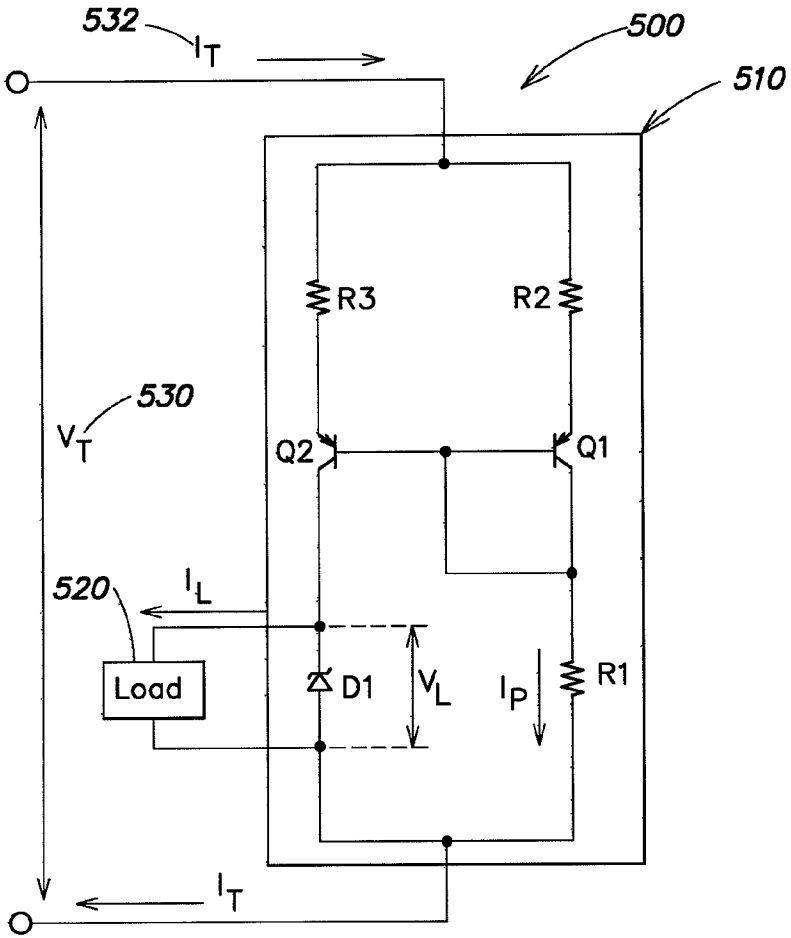
FIG. 11 is a circuit diagram of a converter circuit suitable for the apparatus of FIG. 6, according to another embodiment of the present invention.

FIG. 11 is a circuit diagram showing an example of the converter circuit 510 of the apparatus 500 shown in FIG. 6, according to another embodiment of the present invention. In FIG. 11, the converter circuit 510 employs a current mirror, in which the current flowing through the current mirror is based on the terminal voltage $V_T$. More specifically, in FIG. 11, transistors Q1 and Q2, and "programming" resistor R1, form part of a current mirror that essentially forces the current-to-voltage characteristic of the apparatus, based on the terminal voltage $V_T$ and the terminal current $I_T$, to substantially mirror that of the programming resistor R1 (i.e., substantially linear) over some operating range. Although the circuit of FIG. 11 employs PNP transistors in the current mirror, it should be appreciated that in other implementations NPN transistors or other semiconductor devices may be employed in the current mirror and the circuit appropriately rearranged to provide the same functionality as the circuit illustrated in FIG. 11. The converter circuit shown in FIG. 11 also comprises a voltage regulator such as zener diode D1, in the "load leg" of the current mirror, to provide the load voltage $V_L$. The apparatus behaves essentially as a resistive element when the terminal voltage $V_T$ exceeds the zener voltage (i.e., the load voltage $V_L$) plus a dropout voltage of the current mirror.

Referring to FIG. 11, the current mirror also may optionally include resistors R2 and R3. In some implementations of the circuit shown in FIG. 11, a programming current $I_P$ determined primarily by the programming resistor R1 need not be large, and optional resistors R2 and R3 may be employed to provide a multiplying factor for the current available to the load (and/or the sizes of Q1 and Q2 may be selected to provide some multiplying factor). Because of the diode-connected transistor Q1, the programming current $I_P$ is given by $(V_T-0.7)/(R1+R2)$ (assuming a base-emitter voltage $V_{BE}$ for a typical silicon BJT of approximately 0.7 Volts, and neglecting base current). Assuming transistors Q1 and Q2 are appropriately sized, $V_{BE}$ for the transistors is similar, and so the voltage across resistors R2 and R3 is similar. Thus, the current through the "load leg" of the current mirror (to which the load 520 is connected across the zener diode D1) is determined by $I_P*(R2/R3)$; hence the multiplying factor provided by resistors R2 and R3. The current $I_P*(R2/R3)$ is chosen to be greater than the maximum current $I_L$ that can be drawn by the load 520, and sufficient to keep the zener diode conducting at the maximum load current. Whatever current is not required by the load 520 at any given time is shunted by the zener diode D1, such that the terminal current $I_T$ through the apparatus is independent of the load current, and given by $I_P[1+(R2/R3)]$.

Figure 12:
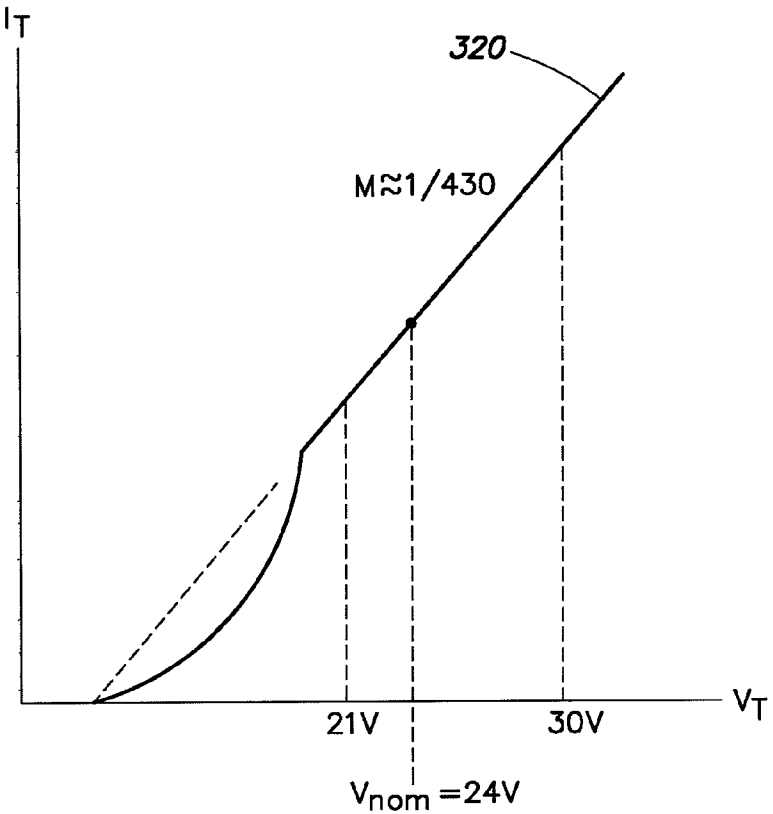
FIG. 12 illustrates a plot of a current-to-voltage characteristic for the apparatus of FIG. 11.

FIG. 12 illustrates a plot 320 of a current-to-voltage characteristic for the apparatus 500 shown in FIG. 11. As shown in FIG. 12, above some threshold voltage at which the zener diode D1 and current mirror begin to conduct, the plot is substantially linear. In this region, the relationship between $I_T$ and $V_T$ is given by:

$$I_T = I_P\left(1+\frac{R2}{R3}\right) \tag{3}$$

$$I_P = \frac{V_T-0.7}{R1+R2}$$

$$I_T = V_T\left(\frac{1+\frac{R2}{R3}}{R1+R2}\right) - 0.7\left(\frac{1+\frac{R2}{R3}}{R1+R2}\right).$$

From the above, according to $I_T=mV_T+b$, it may be appreciated that the extended linear portion of the I-V characteristic has a non-zero (negative) intercept on the vertical axis (which corresponds to a positive intercept on the horizontal axis, as can be observed in FIG. 12). The effective resistance $R_{eff}$ of the apparatus in this region of the plot is given by:

$$R_{eff} = \frac{1}{m} = \frac{R1+R2}{1+\frac{R2}{R3}}. \tag{4}$$

It may also be appreciated that, because of the non-zero intercept, the apparent resistance at a given operating point is not equal to the effective resistance $R_{eff}$; rather, the effective resistance is generally lower than the apparent resistance due to the negative intercept.

Like the apparatus of FIG. 9, the apparatus illustrated in FIG. 11 may be configured to operate based on a variety of possible terminal voltages $V_T$. In one exemplary implementation, a nominal load voltage $V_L$ is taken to be approximately 20 Volts (the zener diode D1 is specified to regulate at 20 Volts), and a maximum load current $I_L$ is taken to be approximately 45 milliamps. This provides a guideline for an apparent resistance of approximately 440 Ohms for the apparatus at a nominal operating point. Based on these exemplary parameters, the terminal voltage $V_T$ of the power source is taken to be approximately 24 Volts, and a current flowing through the "load leg" of the current mirror (in which the load is connected across the zener diode D1) may be set to approximately 55 milliamps to ensure the zener diode remains sufficiently biased at full load current. A programming current $I_P$ of approximately 1.1 milliamp may be selected by choosing R1=21 kΩ, R2=1 kΩ and R3=20Ω (to provide a multiplying factor of approximately 50). In one exemplary implementation, diode connected transistor Q1 may be a 2N3906, and transistor Q2, handling the higher current in the "load leg," may be a FZT790.

Based on the formulas above for the current-to-voltage characteristic and effective resistance of the circuit in FIG. 11, this exemplary apparatus has an effective resistance $R_{eff}$ of approximately 430Ω in the linear region of the I-V characteristic plot, which is approximately $0.98(V_T/I_T)$ at a nominal terminal voltage of 24 Volts. From FIG. 12, in which parameters specific to the example above are used for purposes of illustration, it may be observed that this particular implementation of the circuit of FIG. 11 may operate over a range of terminal voltages from approximately 21 Volts to approximately 30 Volts while providing a substantially linear current-to-voltage characteristic.

While the circuit of FIG. 11 illustrates a current mirror employing BJTs for the transistors Q1 and Q2, it should be appreciated that according to other implementations involving a current mirror, current mirrors may be implemented using FETs, operational amplifiers, CASCODE devices, or other components to achieve greater accuracy, require lower programming current, achieve lower dropout voltages, and facilitate integrated circuit implementation. The relationships given in Eqs. (3) and (4) above may be generalized to represent a variety of converter circuit implementations based on current mirrors. For example, denoting the multiplying factor of a current mirror as g (e.g., g=R2/R3 in Eqs. (3) and (4)), and denoting the sum of the resistor values in the "programming leg" of the current mirror as p (e.g., p=(R1+R2) in Eqs. (3) and (4)), Eq. (3) may be re-written as:

$$I_T = V_T\left(\frac{1+g}{p}\right) + b, \tag{5}$$

where the value b in Eq. (5) represents the vertical axis intercept and is related to a voltage across a diode-connected transistor in the programming leg of the current mirror (e.g., Q1 in FIG. 11). Similarly, Eq. (4) may be re-written as:

$$R_{eff} = \frac{p}{1+g}. \quad (6)$$

From Eq. (5), it may be observed that for negative values of b, the effective resistance is generally lower than the apparent resistance at a nominal operating point and for positive values of b, the effective resistance is generally greater than the apparent resistance at a nominal operating point. Some examples of alternative current mirror implementations are discussed below.

Figure 14:
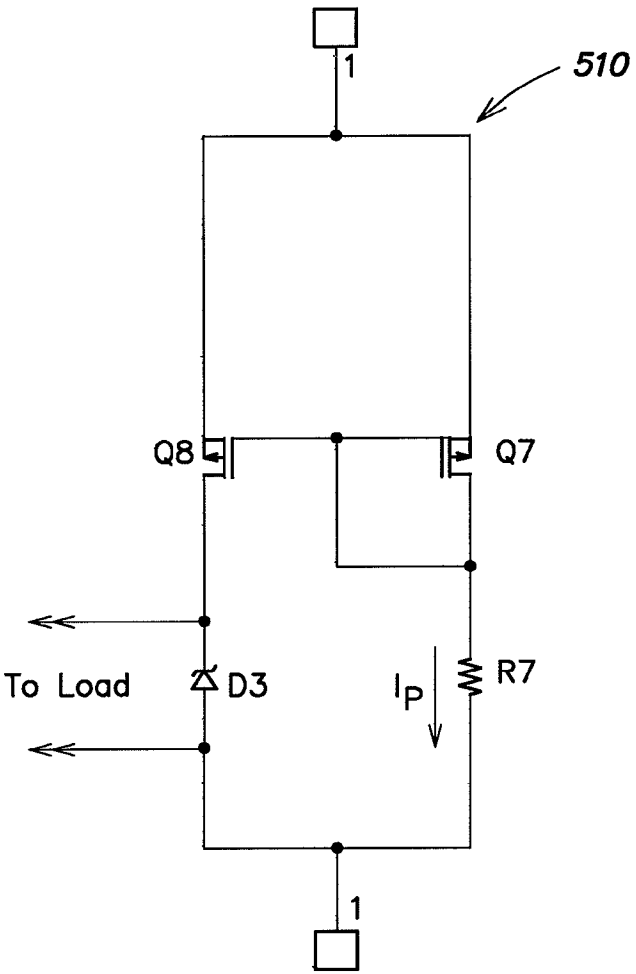
FIGS. 13 and 14 are circuit diagrams of FET-based converter circuits suitable for the apparatus of FIG. 6, according to other embodiments of the present invention.
Figure 13:
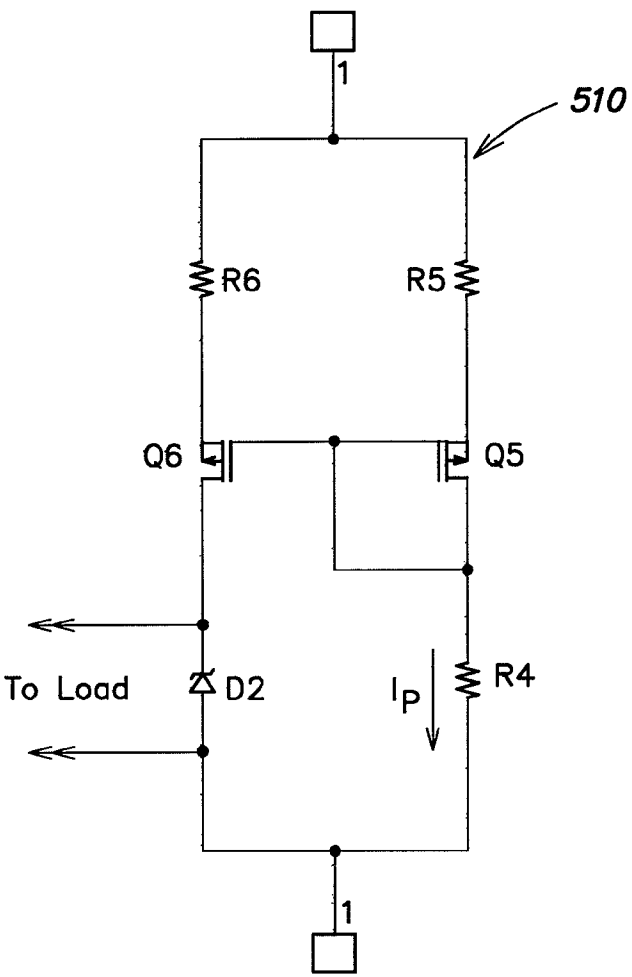

FIGS. 13 and 14 are circuit diagrams showing other FET-based examples of the converter circuit 510 shown in FIG. 6, according to alternative embodiments of the present invention. In the examples shown in FIGS. 13 and 14, P-channel MOSFETs are employed, although it should be appreciated that N-channel MOSFETs similarly may be employed and the circuit rearranged appropriately. In FIG. 13, resistors R5 and R6 are used to provide a multiplying factor between the programming current $I_P$ and the current in the "load leg," in a manner similar to that discussed above in connection with FIG. 11. More specifically, substituting for the parameters in Eqs. (5) and 6 based on the components in FIG. 13, g=R5/R6, p=R4+R5, and b relates to a drain-source voltage across MOSFET Q5. Additionally, or alternatively to employing resistors R5 and R6 as shown in FIG. 14, respective width-to-length ratios (W/L) of the FETs may be chosen to implement a multiplying factor g. In one implementation, this may be achieved in an integrated circuit design by ganging together multiple FETs for any one of the FETs employed in the current mirror so as to achieve a desired multiplying factor.

Employing MOSFETs in the converter circuit 510 facilitates an integrated circuit implementation of the apparatus 500. Also, as noted above in connection with FIG. 9, the converter circuits of FIGS. 13 and 14 do not include any energy storage components, further facilitating an integrated circuit implementation. Referring to FIGS. 13 and 14, in exemplary implementations, the load may include or consist essentially of an LED-based lighting unit similar to the lighting unit 100 shown in FIG. 4, wherein the LED-based lighting unit includes one or more LEDs 104 and control circuitry for the LED(s) (e.g., the controller 105). In some versions of these implementations, a converter circuit employing FETs and the control circuitry for the LED(s) (e.g., the controller 105) can be executed as a single integrated circuit to which the LED(s) is/are coupled.

Figure 15:
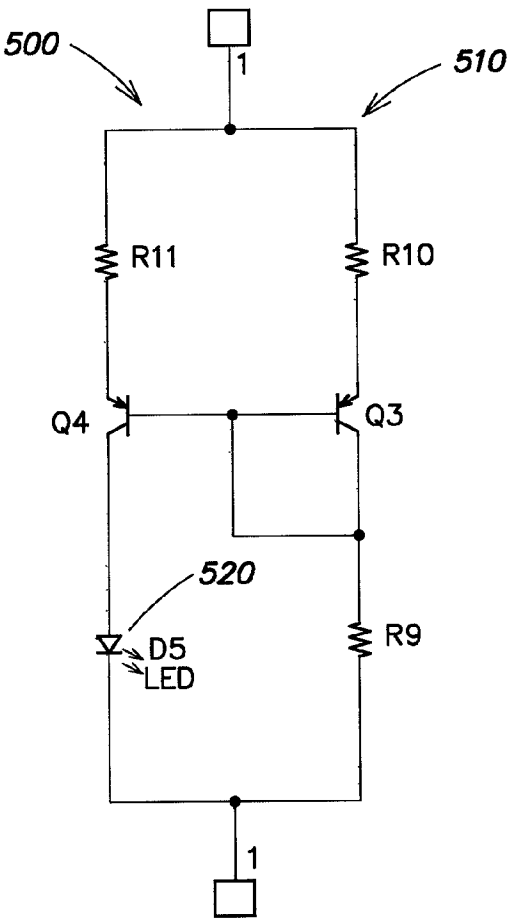
FIG. 15 is a circuit diagram of another exemplary apparatus for altering a current-to-voltage characteristic of a load including a voltage-limited load, according to one alternative embodiment of the present invention.

With reference again to FIG. 11, if the load 520 has a generally voltage-limited current-to-voltage characteristic (e.g., as shown in FIG. 2 for a conventional LED), according to other embodiments it is further possible to "integrate" the load with the current mirror circuitry of any of the converter circuits shown in FIGS. 11, 13 and 14 by replacing the zener diode with the load itself. An exemplary configuration based on FIG. 11 is shown in FIG. 15, in which the zener diode is replaced by a single LED load. The resulting apparatus 500 has the I-V characteristic illustrated in FIG. 12, and multiple such apparatus may be connected (via the square terminals shown in FIG. 15) in a variety of series, parallel or series-parallel arrangements. The apparatus shown in FIG. 15 based on a load including a single LED may be advantageous in applications in which it would be convenient to have replaceable LED nodes in a system of multiple such nodes, in which the terminal voltage and terminal current of each node is predictable. This would provide for substitution of one LED type for another, especially where the forward voltages of LEDs may be different. Also, as discussed above, and FET implementation would facilitate an integrated circuit integration, in which an LED may be mounted to, or fabricated on, a single integrated circuit including the remaining components of the converter circuit.

Figure 16:
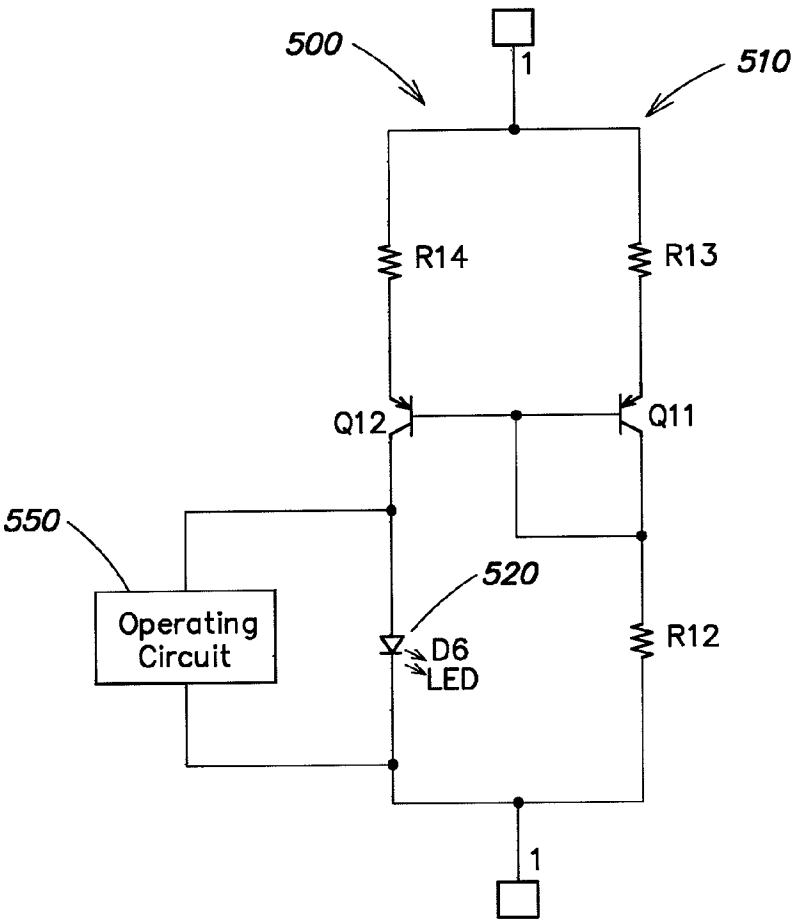
FIG. 16 is a circuit diagram based on the apparatus of FIG. 15, in which the apparatus further includes an operating circuit to control the voltage-limited load.

The circuit illustrated in FIG. 15 may be further modified to allow operating parameters (e.g., on/off state or brightness) of the LED load 520 to be varied. For example, as shown in FIG. 16, a "blinking" LED apparatus 500 may be implemented by adding an operating circuit 550 configured to divert current around the LED load. The LED may be turned on and off by the operating circuit 550 by drawing sufficient current to reduce the voltage across the LED load slightly below the forward voltage of the LED, or by switching in a low impedance to essentially divert all or a significant portion of the current in the load leg of the current mirror around the LED load. With reference again to FIG. 7, such blinking LED apparatus 500 may be connected in series (via the square terminals shown in FIG. 16) to form a lighting system that provides a string of blinking LEDs.

Figure 17:
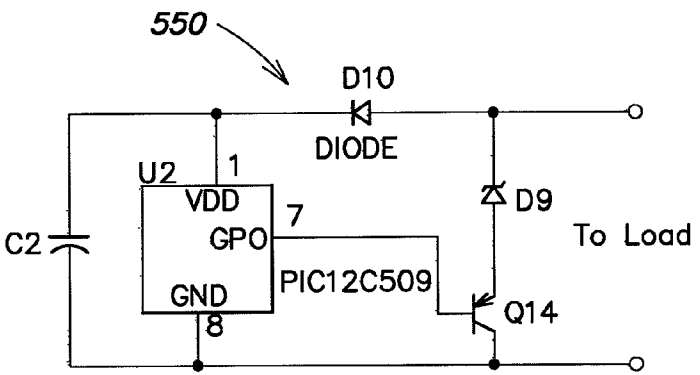
FIG. 17 is a circuit diagram showing an example of the operating circuit illustrated in FIG. 16.

One exemplary operating circuit that may be employed in the device shown in FIG. 16 is depicted in FIG. 17. In FIG. 17, a microcontroller U2 (e.g., PIC12C509) is configured to divert the current away from the LED. The microcontroller may be replaced with a timer of any other appropriate sort, including various analog or digital circuits. Components D10 and C2 provide power to the microcontroller, and transistor Q14 along with zener diode D9 provide the alternate current path. The voltage of zener diode D9 is chosen to such that its voltage, plus the base-emitter voltage of Q14 (about 0.7V), is less than the LED forward voltage (i.e., the load voltage) in FIG. 16. In one implementation, D9 may be omitted if: 1) the current mirror chosen to run this operating circuit has sufficient power handling ability; 2) the mirror output impedance is large enough to prevent large mirror errors; and 3) capacitor C2 is sized large enough to enable operation of the microcontroller during the time when the LED is off. Diode D9 can have a forward voltage large enough, especially when the voltage across the LED is large, to provide continuous power to the timer circuit. This allows a minimal capacitance to be used for C2. In this case it may be possible to replace D10 with a resistor if the apparatus terminal voltage is not large compared to the voltage requirements of the microcontroller.

Figure 18:
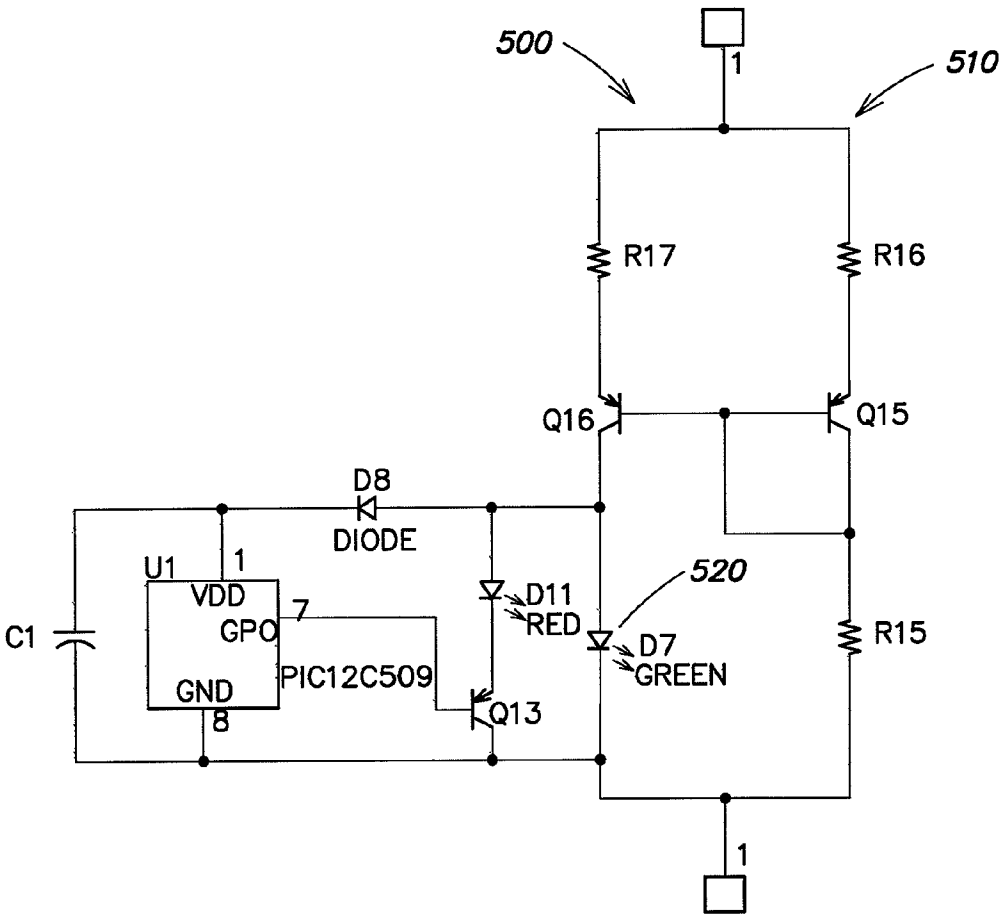
FIGS. 18-20 are circuit diagrams of apparatus for altering a current-to-voltage characteristic of a load, according to various alternative embodiments of the present invention.
Figure 19:
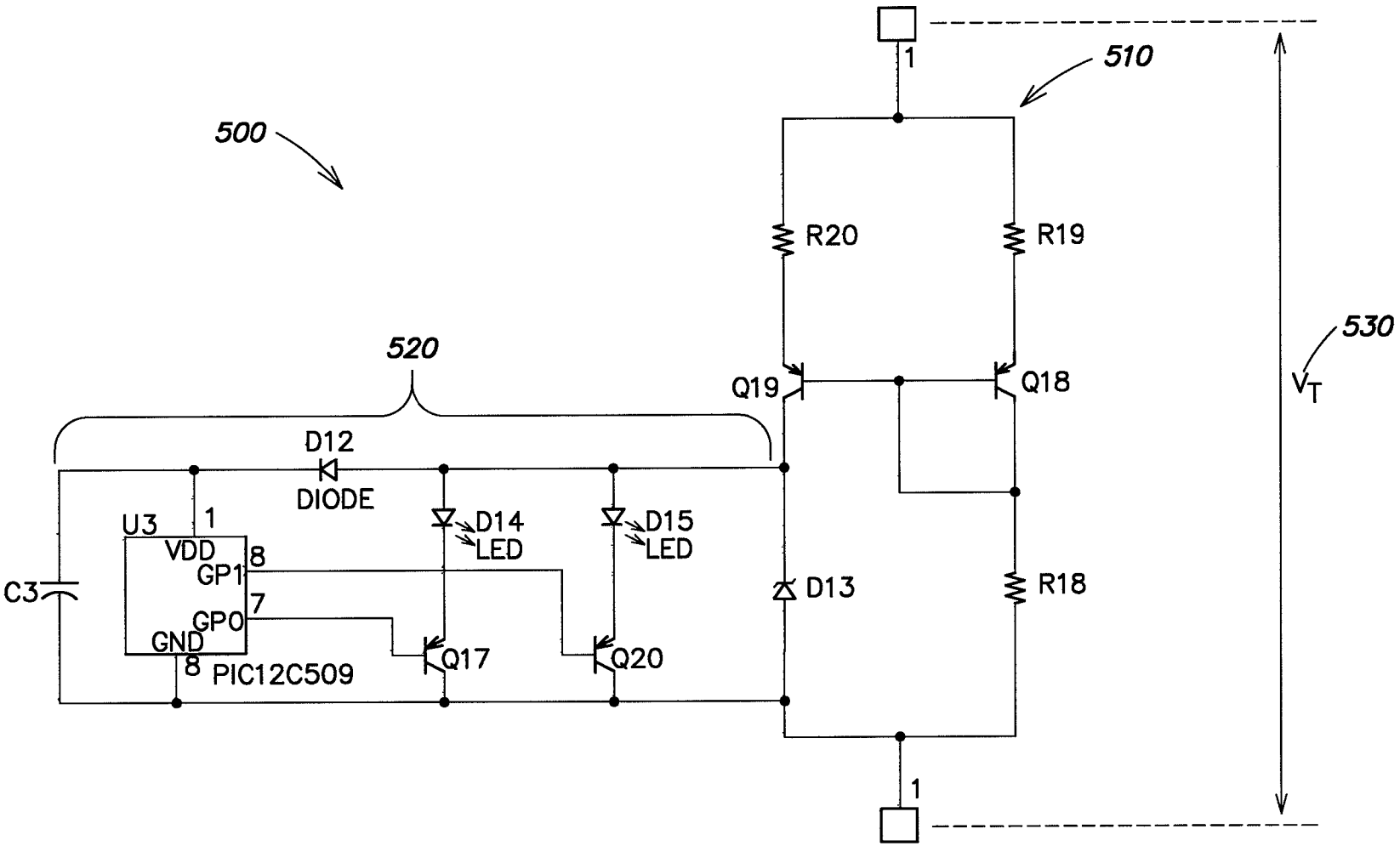

In another embodiment, the diode D9 shown in FIG. 17 may be replaced with a lower voltage LED, and thus a two-color twinkle may be created. Such an apparatus including a voltage-limited load employing two LEDs and an operating circuit to control them is shown in FIG. 18. In the circuit of FIG. 18, one of the two LEDs D7 and D11 must remain on. Note that the LED current is set externally, and no additional current sources are needed; however, if the terminal voltage $V_T$ of the apparatus varies, the LED current also varies. In yet another embodiment shown in FIG. 19, a converter circuit 510 similar to that shown in FIG. 11, employing zener diode D13, is coupled to a load 520 including two LEDs D14 and D15 and operating circuitry similar to that shown in FIGS. 17 and 18, so as to individually and independently switch multiple LEDs on and off. While two independently controlled LEDs are shown in FIG. 19, it should be appreciated that different numbers of LEDs (e.g., three or more), of various colors, may be controlled by the microcontroller U3. It yet another embodiment, based on FIG. 19, the load 520 may be replaced by the LED-based lighting unit 100 discussed above in connection with FIGS. 4 and 5, wherein current to individual LEDs (or groups of LEDs having a same or similar spectrum) may be respectively controlled independently of each other and independently of the terminal voltage $V_T$ of the apparatus.

As indicated earlier, the general functionality of the circuits discussed above in connection with FIGS. 11-19 may be implemented using other circuit variants without deviating from the scope and spirit of the invention. As illustrated herein, PNP and NPN BJTs, as well as PFETs and NFETs may be employed in various current mirror configurations. Current mirrors also may be implemented with op-amps, CASCODE devices, or other components to achieve greater accuracy, require lower programming current, lower dropout voltage or have other desirable features.

As noted in connection with FIG. 12, the circuits discussed above employing a current mirror generally do not have current-to-voltage characteristics having a linear portion that, when extended, intercepts the origin on the I-V graph. Rather, in the case of circuit shown in FIG. 11 employing BJTs, the extended linear portion of the I-V characteristic plot has a negative intercept along the vertical axis, as indicated by Eqs. (3). In particular, the intercept along the horizontal (voltage) axis is at least one diode-connected transistor voltage drop above zero Volts (e.g., 0.7 Volts). In circuits employing MOS devices in the current mirror, the voltage axis intercept may be on the order of two or more Volts.

Figure 20:
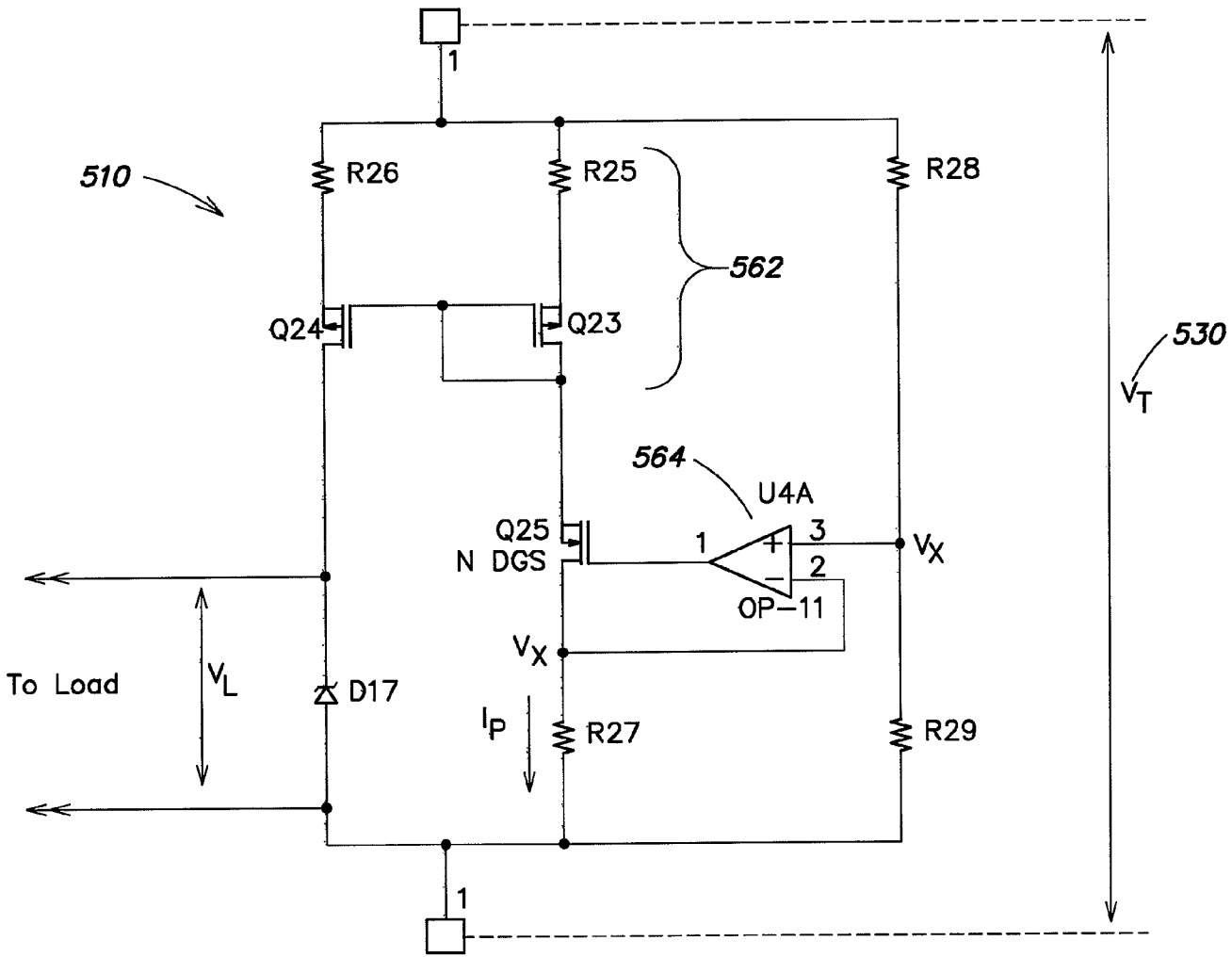

For implementations in which it may be desirable for the current-to-voltage characteristic of the apparatus 500 to have an origin intercept on the I-V graph, a current source based on an operational amplifier, as discussed above in connection with FIGS. 9 and 10, may be employed. Alternatively, according to other inventive embodiments employing current mirrors in the converter circuit 510, an operational amplifier current source similar to that shown in FIG. 9 may be employed together with a current mirror. FIG. 20 is a circuit diagram showing such an example of the converter circuit 510, in which a MOSFET current mirror 562 is coupled to a programming circuit 564 including the operational amplifier U4A.

Figure 21:
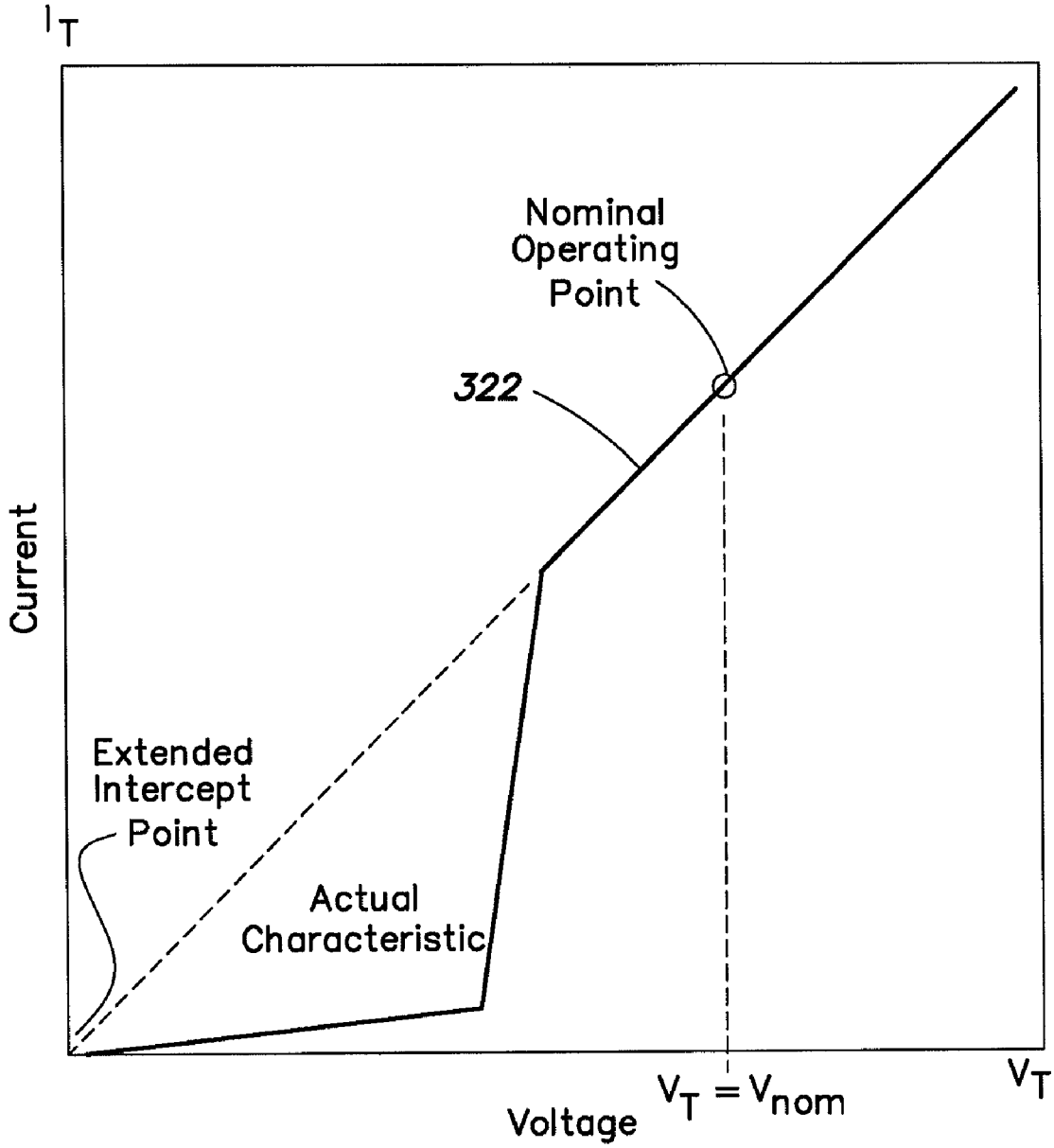
FIG. 21 illustrates a plot of a current-to-voltage characteristic for the apparatus of FIG. 20.

In the circuit of FIG. 20, the resistor R27 serves as the programming resistor for the current mirror, and a control voltage $V_X$ across the programming resistor is set to be a fraction of the terminal voltage $V_T$ via the voltage divider formed by R28 and R29. As a result, the programming current $I_P$ is not a function of any voltage drops across the diode-connected MOSFET Q25, and the resulting apparatus has an I-V characteristic plot 322 with an extended linear portion intercept close to or at the origin of the I-V graph, as shown for example in FIG. 21. In one aspect, this would allow a larger number of apparatus to be connected in series, since the better accuracy generally results in less of a spread of terminal voltages in a series-connected string of apparatus as shown in FIG. 7.

While FIG. 20 provides another implementation of a converter circuit for apparatus having an I-V characteristic with an extended linear portion having an origin intercept, it should be appreciated that this is by no means a necessary characteristic for operation of apparatus in a variety of applications. More generally, apparatus according to various inventive embodiments discussed herein may have a substantially linear or quasi-linear current-to-voltage characteristic over some range of anticipated terminal voltages during normal operation that may or may not be extended to intercept the origin of the I-V graph. Also, the degree of required linearity may be different for different applications. In part, this may be determined by analyzing any significant sources of error in the converter circuit (component mismatches resulting in any offsets, nonlinearities, or differences from apparatus to apparatus), and determining the resulting effective terminal voltage mismatch amongst two or more apparatus. While these errors may be reduced, any required degree of error reduction may be application dependent. For example, if sufficient extra power source voltage is available for a given application, and extra power dissipation in some apparatus is tolerable, then further measures may be unnecessary to ensure more similar current-to-voltage characteristics for multiple apparatus to be connected together to draw power from the power source.

In yet other inventive embodiments, converter circuits for the apparatus 500 shown in FIG. 6 may be configured to purposefully impose a non-zero intercept for an extended linear portion of an I-V characteristic, so that an effective resistance of the apparatus may be significantly different than the apparent resistance at a nominal operating point. In particular, a converter circuit may be configured such that the effective resistance of an apparatus in a range around a nominal operating point ($V_T=V_{nom}$) may be greater or less than the apparent resistance $R_{app}=V_T/I_T$ at the nominal operating point via the imposition of a non-zero intercept.

For example, an effective resistance $R_{eff}=nR_{app}$, where $n>1$, may be employed to decrease the voltage dependence of the apparatus' terminal current. In applications in which voltage excursions above a nominal operating point may be expected, this greater effective resistance results in less device power dissipation over such voltage excursions. For example, by merely doubling the apparent resistance, i.e., $R_{eff}=2R_{app}$, a 50% power savings at voltages higher than the nominal operating point may be achieved, and at $n=4$, a 75% power saving may be achieved. Effective voltage sharing in some cases may become more difficult to achieve for greater values of n, since small stray current errors can cause proportionally larger changes in the respective terminal voltages of multiple series-connected apparatus; however, this effect may be insignificant in many applications. Alternatively, an effective resistance $R_{eff}=nR_{app}$, where $n<1$, may be employed to enforce better voltage sharing amongst a string of series-connected apparatus at higher power source voltages, or for various other operational reasons. One such reason relating to multiple series-connected apparatus having one or more light sources as loads, and a power source comprising a battery, may be to maximize light output at higher battery voltages. While theoretically the multiplier n may have any value, according to various embodiments discussed herein converter circuits may be configured such that the multiplier n may have values at least in a range of from $0.1<n<10$; more particularly, in some exemplary implementations n may have values in a range of from $1<n<4$.

To vary the multiplier n and hence the effective resistance of a given apparatus based on the converter circuit of FIG. 9, a positive or negative voltage may be inserted in series with the resistor R51 so as to provide an offset to the control voltage $V_X$; alternatively, a positive or negative current may be added at the non-inverting input of operational amplifier U50 to provide an offset to the control voltage $V_X$. Other methods of introducing a deliberate offset may also be employed. In a similar manner, in converter circuits employing a current mirror, a positive or negative voltage may be inserted in series with the programming resistor or, alternatively, a positive or negative fixed current may be added in parallel with the programming current $I_P$ to achieve these characteristics. It should be appreciated that the foregoing may be implemented in a number of different ways, with a variety of different circuits, and that other methods of varying the effective resistance may also be used.

Figure 23:
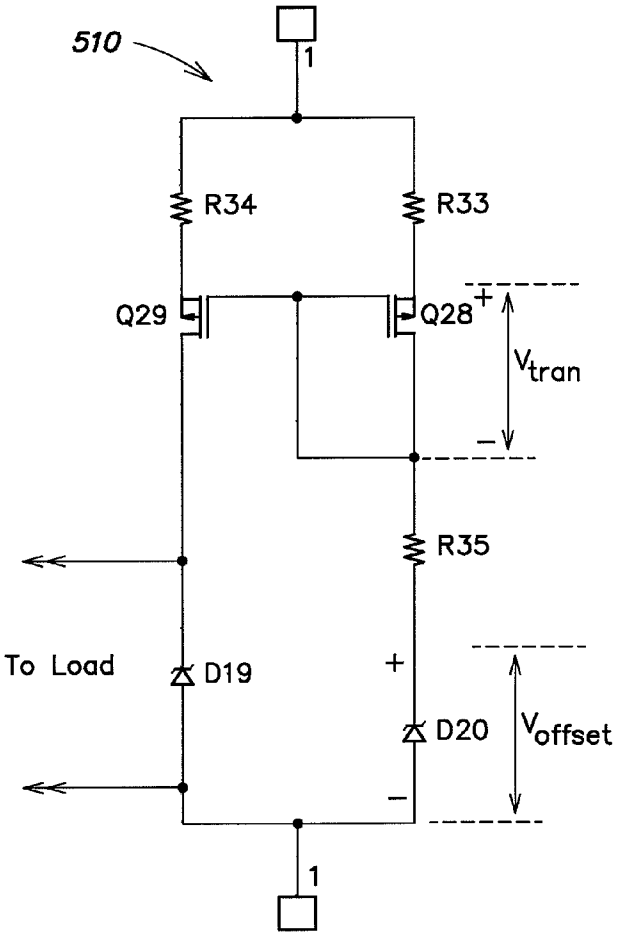
FIGS. 22 and 23 are circuit diagrams showing other examples of the converter circuit of the apparatus shown in FIG. 6, in which the effective resistance of the apparatus around some nominal operating point is altered in a predetermined manner, according to other embodiments of the present invention.
Figure 22:
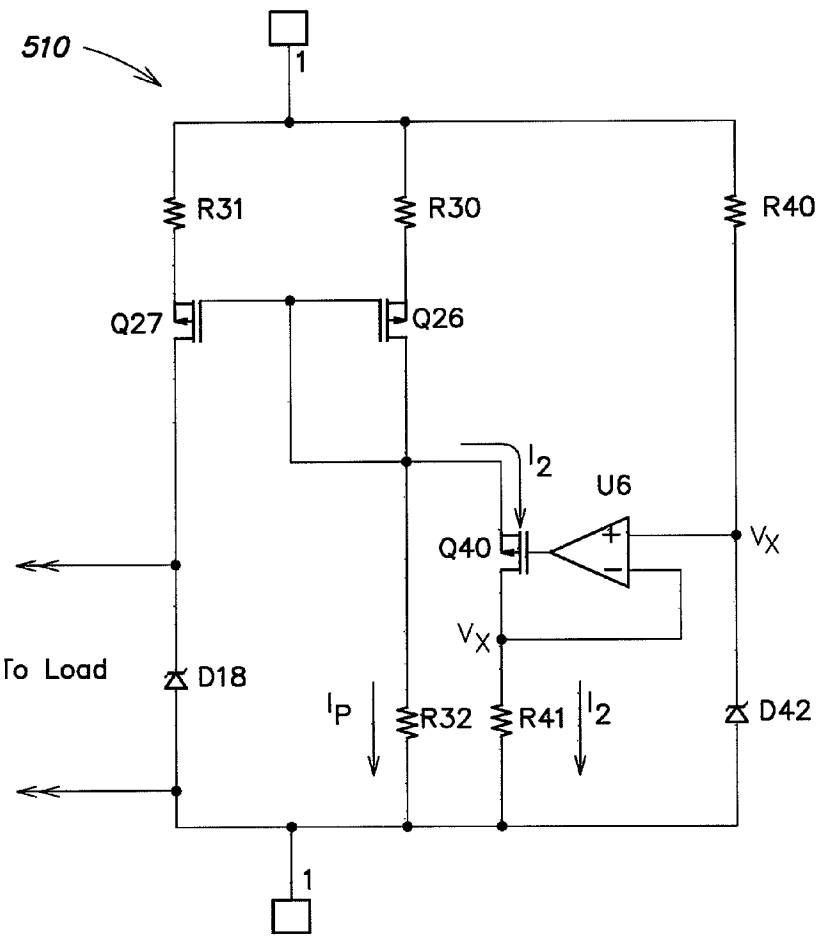

For example, FIGS. 22 and 23 are circuit diagrams showing other examples of the converter circuit 510 of the apparatus shown in FIG. 6, in which a non-zero intercept of an I-V characteristic is imposed in a predetermined manner so as provide an effective resistance that is different than an apparent resistance at a nominal operating point, according to other inventive embodiments. In FIG. 22, a current mirror configuration is employed, in which an additional fixed current $I_2$ flows in parallel to the programming current $I_P$. A current source configuration similar to that shown in FIG. 20, comprising resistors R40, R41, zener diode D42, transistor Q40, and operational amplifier U6, is employed to generate the current $I_2$. Eq. (5) may be altered to take into account the fixed current $I_2$, giving the I-V relationship for the circuit of FIG. 22:

$$I_T = V_T\left(\frac{1+g}{p}\right) + b + I_2(1+g). \tag{7}$$

From Eq. (7), it may be observed that the fixed current may be chosen so as to cancel the vertical axis intercept b (i.e., the effect of the diode connected transistor), or to provide other net positive or negative values for a vertical axis intercept. At a given nominal operating point $V_T = V_{nom}$ and corresponding current $I_T$, higher positive values for $I_2$ (a net positive intercept) allow for higher effective resistances and, conversely, more negative values for $I_2$ (a net negative intercept) allow for lower effective resistances. FIG. 23 illustrates how the vertical intercept of the extended linear portion of the I-V characteristic can be moved downward (i.e., to more negative currents) via the addition of a fixed voltage $V_{offset}$ (e.g., imposed by zener diode D20 or some other type of voltage reference) in series with the programming resistor. With reference to Eqs. (3) and (5), the voltage $V_{offset}$ is added to a voltage $V_{tran}$ across the diode-connected transistor Q28 resulting in an increased negative value for the parameter b. This same technique can be used in connection with the programming resistor R32 or the resistor R40 shown in FIG. 22.

More generally, it can be shown that various characteristics may be generated through the use of multiple floating reference diodes and resistors to generate the control voltage Vx, optionally adding operational amplifiers or other circuits for purposes of accuracy or convenience. Such circuits are often referred to as piece-wise linear, in that they have multiple substantially linear pieces to their function. The construction of circuits to generate such a function is generally understood. The desired control voltage $V_X$ is derived from the terminal voltage $V_T$, and a voltage-to-current converter circuit configuration such as those shown in FIG. 20 or 22 (or any other suitable circuit) may be employed to generate a current in parallel with the programming current, which may then be used to create a larger current for the load. Alternatively, and as shown in one embodiment in FIG. 9, the current mirror can be avoided in situations where the load is suitable, and the operational amplifier can be tasked with the additional function of subtracting out the already flowing load current in the control of an adjustable shunt.

As discussed above in connection with FIGS. 4 and 5, a controllable LED-based lighting unit 100 may receive, process and transmit data in a serial manner, wherein the processed data facilitates control of various states of light (e.g., color, brightness) generated by the lighting unit. Exemplary current-to-voltage characteristics for such a lighting unit were discussed above in connection with FIG. 3. Such a lighting unit may serve as the load 520 in the apparatus 500 shown in the embodiment of FIG. 6 and various other embodiments discussed herein so as to provide altered current-to-voltage characteristics (e.g., such that the apparatus including the lighting unit 100 appears as a linear or resistive element to a power source from which it draws power). As discussed above in connection with FIG. 7, such apparatus may then be arranged in a variety of serial or serial/parallel combinations to receive power from the power source.

Figure 25:
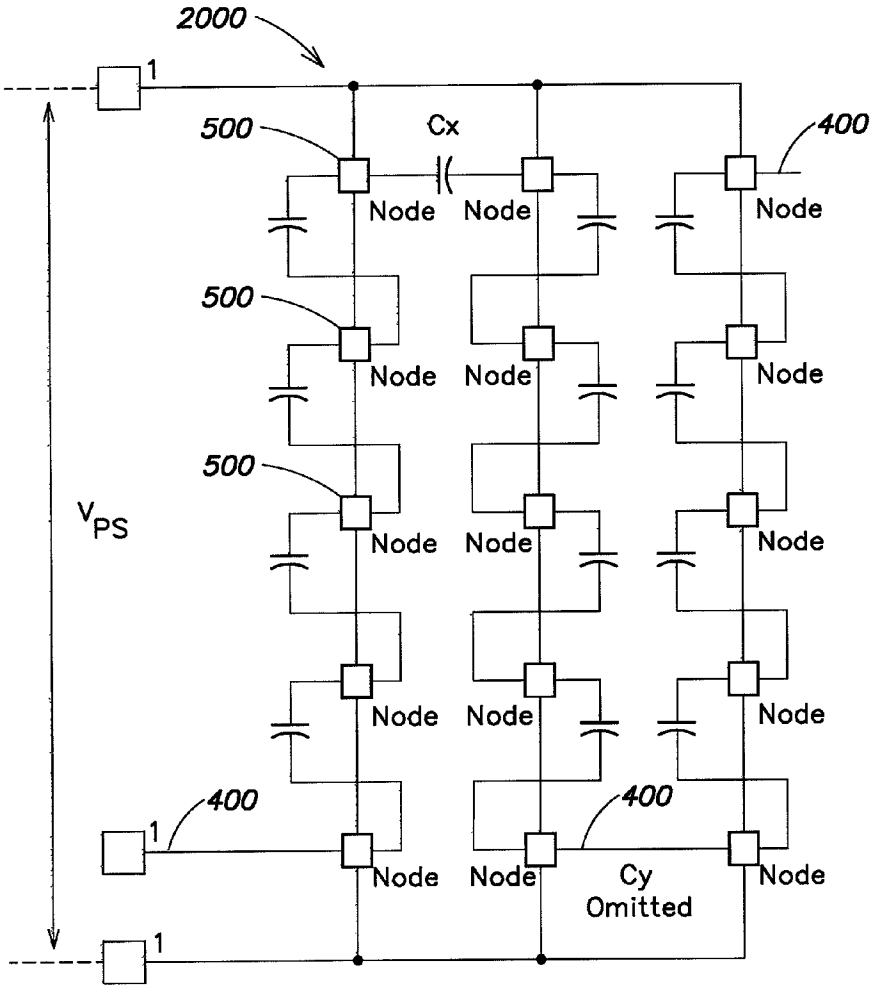
FIGS. 24 and 25 illustrate exemplary lighting systems including a plurality of series or series-parallel connected apparatus of FIG. 6, according to still other embodiments of the present invention.
Figure 24:
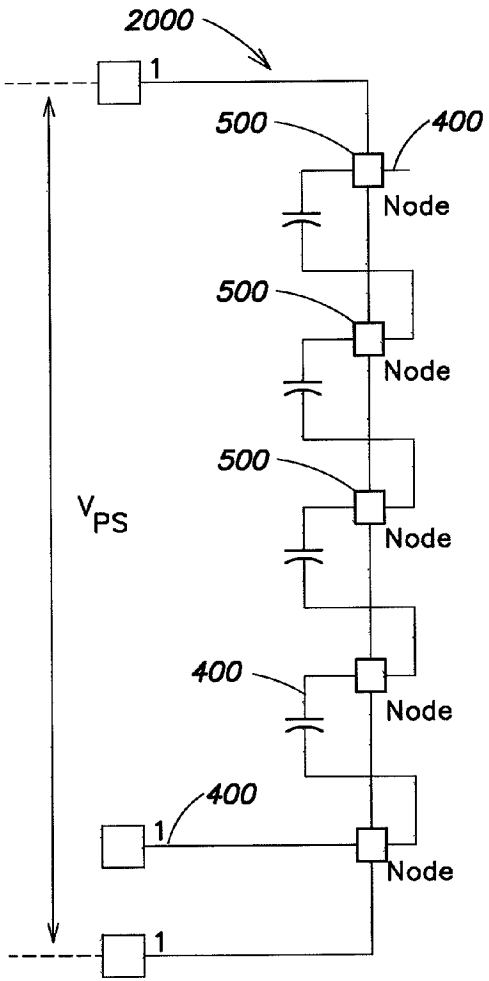

Based on the serial power connection of apparatus shown in FIG. 7, FIGS. 24 and 25 illustrate some exemplary lighting systems 2000 comprising a plurality of apparatus 500 each including a lighting unit 100. Similar to FIG. 7, each apparatus 500 shown in FIGS. 24 and 25 (indicated by a small square) constitutes a "lighting node" of the lighting systems 2000, and the plurality of lighting nodes are coupled in series (FIG. 24) or series-parallel (FIG. 25) to draw power from a power source having a power source terminal voltage $V_{PS}$.

In FIGS. 24 and 25, the plurality of nodes not only receives power in a serial manner but is also configured to have the nodes process data in a serial manner. In particular, the systems includes a data line 400 that is coupled to the communication ports 120 (see FIGS. 4 and 5) of each node in a serial manner. In one particular embodiment, the data from any node may be connected to the next node through the use of capacitive coupling. Larger systems of multiple lighting units may be created by coupling together in a parallel manner multiple strings of serially-connected lighting units, as shown in FIG. 25. In such serial-parallel arrangements, capacitors for capacitive coupling of data lines may be used between nodes at the same voltage as shown at Cx, or may be omitted as shown by the absence of Cy. In another embodiment, the data network and node stacking may be arbitrary; i.e., there is no requirement that the data follow from one node to the next in any particular pattern. The capacitive coupling shown can allow data to be transferred in an arbitrary sequence or order among nodes. In one exemplary two-dimensional arrangement of nodes (e.g., based on a serial-parallel arrangement of nodes similar to that shown in FIG. 25), data may flow from row to row or from column to column, or in virtually any other fashion.

Figure 26:
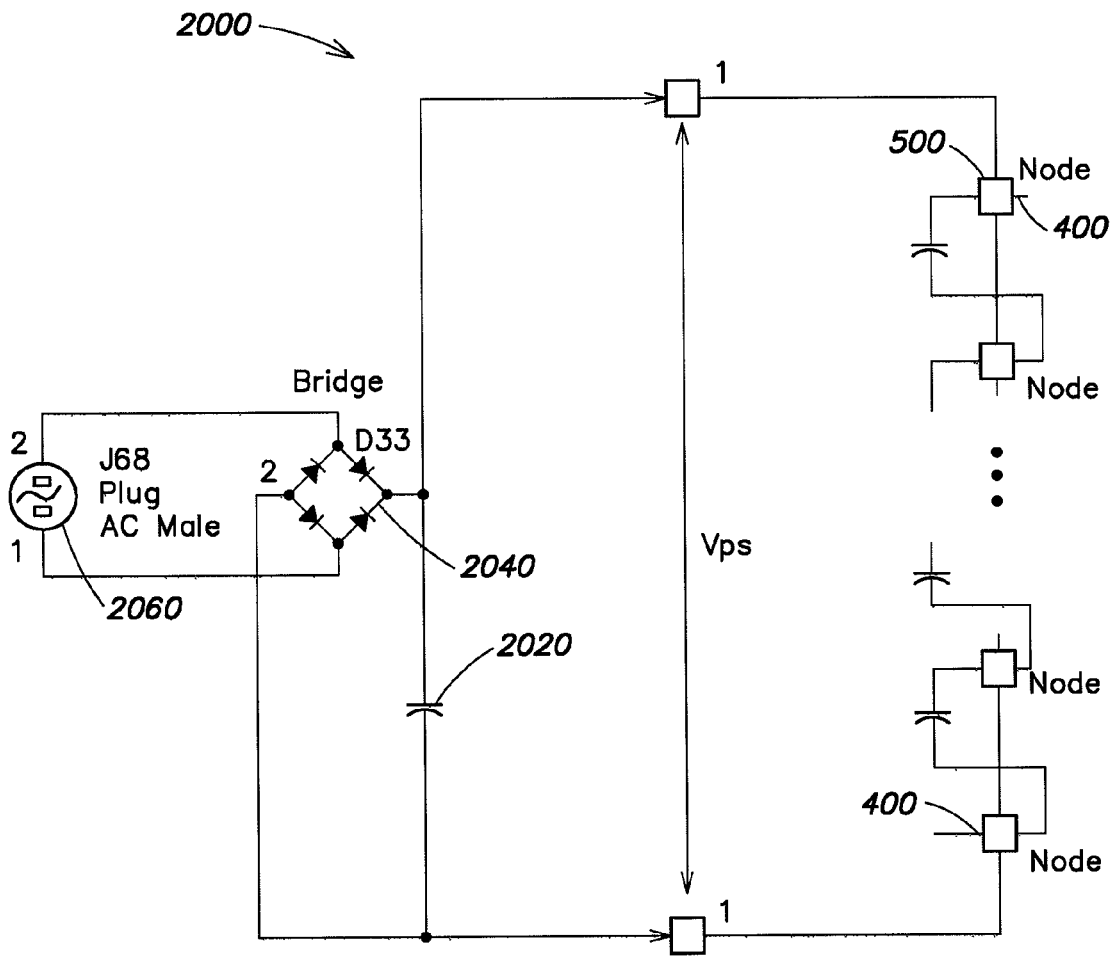
FIG. 26 illustrates a lighting system similar to those shown in FIGS. 24 and 25, further including a filter and bridge rectifier for direct operation from an AC line voltage, according to a particular embodiment of the present invention.

FIG. 26 illustrates that a lighting system 2000 similar to those shown in FIGS. 24 and 25 may further comprise a filter, formed by capacitor 2020, and a bridge rectifier 2040, and thus be operated directly from an A.C. power source 2060 (e.g., having a line voltage of 120 $V_{RMS}$ or 240 $V_{RMS}$) without any further voltage reduction circuitry (e.g., a transformer). In one aspect of this embodiment, the number and respective node voltages of serial-connected nodes are selected such that the rectified and filtered AC line voltage (i.e., the voltage $V_{PS}$) is appropriate for providing power to the plurality of nodes. In one exemplary implementation discussed above in connection with FIG. 9, nodes may have nominal terminal voltages on the order of 5 Volts and, accordingly, up to thirty or more nodes may be connected in series between the voltage $V_{PS}$ based on a line voltage of 120 $V_{RMS}$. In another exemplary implementation discussed above in connection with FIG. 11, nodes may have nominal terminal voltages on the order of 24 Volts and, accordingly, up to seven nodes may be connected in series between the voltage $V_{PS}$ based on a line voltage of 120 $V_{RMS}$.

Figure 27:
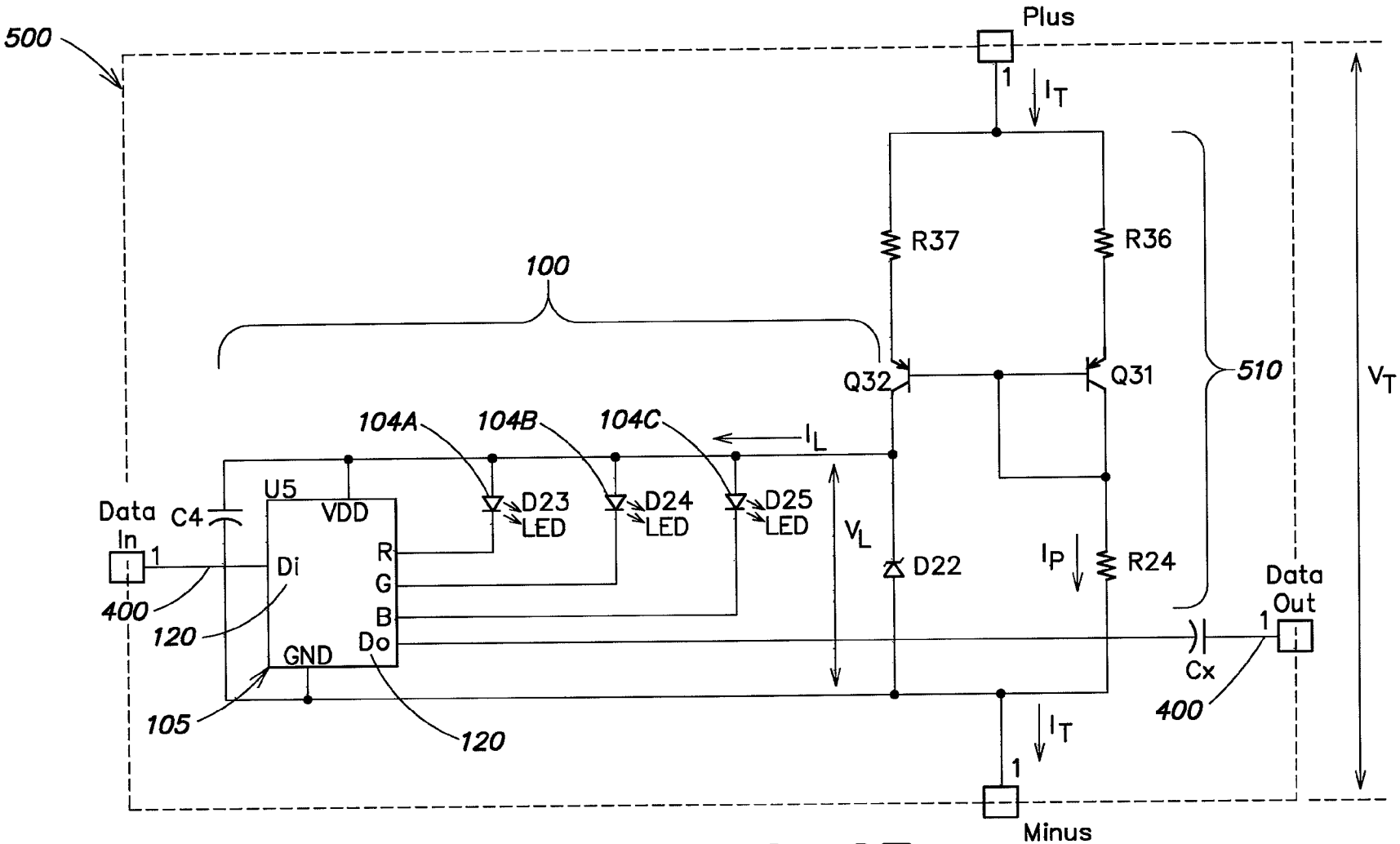
FIG. 27 illustrates an apparatus including an LED-based lighting unit of FIG. 4 and constituting the nodes shown in FIGS. 24, 25, and 26.

FIG. 27 illustrates one example of an apparatus 500 constituting the nodes shown in FIGS. 24, 25, and 26, according to one inventive embodiment, wherein a node comprises a three-channel (e.g., RGB) LED-based lighting unit 100 as discussed above in connection with FIGS. 4 and 5. For purposes of illustration, the lighting unit 100 is shown coupled to a converter circuit 510 based on the configuration of FIG. 11, but it should be appreciated that any converter circuit pursuant to the concepts disclosed herein may be employed in the apparatus.

As discussed above in connection with FIG. 4, the three "channels" of the lighting unit 100 are illustrated in FIG. 27 for simplicity by three LEDs D23, D24 and D25. However, it should be appreciated that these LEDs represent the LED-based light sources 104A, 104B and 104C shown in FIG. 4, wherein each light source may include one or more LEDs configured to generate radiation having a given spectrum, and wherein multiple LEDs of a given light source may be themselves coupled together in series, parallel, or series-parallel arrangements (in one exemplary implementation, a green channel may employ 5 series-connected green LEDs, a blue channel may employ 5 series-connected blue LEDs, and a red channel may employ 8 series-connected red LEDs). As discussed above in connection with FIGS. 24, 25 and 26, the apparatus 500 shown in FIG. 27 can be configured for serial data interconnection via the data lines 400 and the communication ports 120 of the lighting unit's controller 105.

While all of the resistive conversion embodiments presented herein have been continuous time circuits, it should be understood that various forms of DC to DC conversion (examples of which include, but are not limited to, switch-mode power supplies and charge pump circuits) may be utilized to allow better control of load voltage, higher efficiencies, or for other purposes. Furthermore, integrated implementations of the concepts presented here may have more complex structure including a significant number of transistors to achieve a variety of goals, as is generally the case.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of" "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The invention claimed is:

1. An apparatus, comprising:

at least one load having a first current-to-voltage characteristic; and a converter circuit coupled to the at least one load to alter the first current-to-voltage characteristic in a predetermined manner so as to facilitate a predictable behavior of the at least one load when the at least one load is connected in series with at least one other load to draw power from a power source, wherein a first current conducted by the apparatus when the apparatus draws power from a power source is independent of a second current conducted by the load.

2. The apparatus of claim 1, wherein the converter circuit is configured such that the apparatus has a substantially linear current-to-voltage characteristic over at least some range of operation.

3. The apparatus of claim 2, wherein the first current-to-voltage characteristic is nonlinear or variable.

4. The apparatus of claim 1, wherein the apparatus has a terminal voltage $V_T$ and conducts a terminal current $I_T$ when the apparatus draws power from a power source, and wherein the converter circuit is configured such that the apparatus has an effective resistance of between approximately $0.1(V_T/I_T)$ to $10.0(V_T/I_T)$ at least at a nominal operating point $V_T=V_{nom}$ in the at least some range of operation.

5. The apparatus of claim 4, wherein the converter circuit is configured such that the effective resistance is between approximately $1.0(V_T/I_T)$ to $4.0(V_T/I_T)$ at least at the nominal operating point $V_T=V_{nom}$ in the at least some range of operation.

6. The apparatus of claim 4, wherein the converter circuit comprises a variable current source.

7. The apparatus of claim 6, wherein the converter circuit further comprises a voltage regulator to provide an operating voltage for the at least one load.

8. The apparatus of claim 6, wherein the converter circuit further comprises at least one of a fixed current source and a fixed voltage source coupled to the variable current source.

9. The apparatus of claim 6, wherein the converter circuit comprises a single integrated circuit.

10. The apparatus of claim 1, wherein the at least one load comprises at least one LED.

11. The apparatus of claim 10, wherein the at least one LED includes at least one non-white LED.

12. The apparatus of claim 10, wherein the at least one LED includes at least one white LED.

13. The apparatus of claim 1, wherein the at least one load comprises at least one LED-based lighting unit, and wherein the at least one LED-based lighting unit comprises:

at least one first LED to generate first radiation having a first spectrum; and at least one second LED to generate second radiation having a second spectrum different than the first spectrum.

14. The apparatus of claim 13, wherein the at least one first LED includes at least one non-white LED.

15. The apparatus of claim 13, wherein the at least one first LED includes at least one white LED.

16. The apparatus of claim 15, wherein the at least one second LED includes at least one second white LED.

17. The apparatus of claim 1, wherein the converter circuit does not include any energy storage device.

18. The apparatus of claim 17, wherein the at least one load comprises at least one LED, and wherein the apparatus comprises a single integrated circuit.

19. The apparatus of claim 17, wherein the at least one load comprises at least one LED-based lighting unit, wherein the at least one LED-based lighting unit comprises at least one LED and control circuitry for the at least one LED, and wherein the converter circuit and the control circuitry for the at least one LED are implemented as a single integrated circuit to which the at least one LED is coupled.

20. An apparatus, comprising:

at least one light source having an operating voltage $V_L$, an operating current $I_L$, and a first current-to-voltage characteristic based on the operating voltage $V_L$ and the operating current $I_L$; and a converter circuit coupled to the at least one light source to provide the operating voltage $V_L$, the converter circuit configured such that the apparatus conducts a terminal current $I_T$ and has a terminal voltage $V_T$ when the apparatus draws power from a power source, wherein:

the operating voltage $V_L$ of the at least one light source is less than the terminal voltage $V_T$ of the apparatus;

the terminal current $I_T$ of the apparatus is independent of the operating current $I_L$ or the operating voltage $V_L$ of the at least one light source; and the converter circuit alters the first current-to-voltage characteristic in a predetermined manner to provide a second current-to-voltage characteristic for the apparatus, based on the terminal voltage $V_T$ and the terminal current $I_T$, that is significantly different from the first current-to-voltage characteristic; and the second current-to-voltage characteristic facilitates a predictable behavior of the at least one light source when the at least one light source is connected in series with at least one other light source to draw power from the power source.

21. The apparatus of claim 20, wherein the first current-to-voltage characteristic of the light source is nonlinear or variable, and wherein the second current-to-voltage characteristic of the apparatus is substantially linear over a range of voltages above and below the terminal voltage $V_T$.

22. The apparatus of claim 20, wherein the converter circuit is configured such that the apparatus has an effective resistance of between approximately $0.1(V_T/I_T)$ to $10.0(V_T/I_T)$ at least at a nominal operating point $V_T=V_{nom}$.

23. The apparatus of claim 20, wherein the converter circuit is configured such that the effective resistance is between approximately $1.0(V_T/I_T)$ to $4.0(V_T/I_T)$ at least at the nominal operating point.

24. The apparatus of claim 22, wherein the converter circuit comprises a variable current source.

25. The apparatus of claim 24, wherein the at least one light source comprises:

at least one first LED to generate first radiation having a first spectrum; and at least one second LED to generate second radiation having a second spectrum different than the first spectrum.

26. A method, comprising:

altering a first current-to-voltage characteristic of at least one load in a predetermined manner so as to facilitate a predictable behavior of the at least one load when the at least one load is connected in series with at least one other load to draw power from a power source, wherein a first current conducted from the power source is independent of a second current conducted by the at least one load.

27. The method of claim 26, wherein altering the first current-to-voltage characteristic comprises converting the first current-to-voltage characteristic to a substantially linear current-to-voltage characteristic.

* * * * *